United States Patent [19]

Strunc

[11] 4,161,899

[45] Jul. 24, 1979

[54] PHOTOGRAPHIC PAPER CUTTER WITH AUTOMATIC PAPER FEED IN THE EVENT OF OCCASIONAL MISSING CUT MARKS

[75] Inventor: Gerald R. Strunc, Maple Grove, Minn.

[73] Assignee: Pako Corporation, Minneapolis, Minn.

[21] Appl. No.: 937,250

[22] Filed: Aug. 24, 1978

Related U.S. Application Data

[63] Continuation of Ser. No. 837,999, Sep. 29, 1977, abandoned.

[51] Int. Cl.[2] ..... B26D 5/34; B26D 7/06

[52] U.S. Cl. ..... 83/371; 83/211; 83/71

[58] Field of Search ..... 83/371, 364, 365, 208, 83/210, 211, 62, 71

[56] References Cited

U.S. PATENT DOCUMENTS

| | | | |
|---|---|---|---|
| 3,143,017 | 8/1964 | Donnell | 83/211 |
| 3,793,915 | 2/1974 | Hujer | 83/371 |
| 3,811,768 | 5/1974 | Zahn et al. | 83/365 |
| 3,868,877 | 3/1975 | Shoji et al. | 83/210 |
| 3,933,069 | 1/1976 | Tall et al. | 83/371 |
| 3,948,125 | 4/1976 | Hujer et al. | 83/364 |
| 4,056,024 | 11/1977 | Baert et al. | 83/371 |

*Primary Examiner*—Donald R. Schran

*Attorney, Agent, or Firm*—Kinney, Lange, Westman and Fairbairn

[57] ABSTRACT

An automatic photographic paper cutter cuts photographic prints from a strip of photographic paper which bears cut marks indicating the locations of desired paper cuts. An automatic paper feed control allows a predetermined number of cut marks to be missing without halting the operation of the paper cutter. A total feed length for the last previous paper feed-and-cut cycle in which cut marks were sensed at both ends of the cycle is stored and continuously updated with each paper feed-and-cut cycle. If a cut mark is not sensed within a predetermined length or "window", the automatic paper feed control causes the paper to be driven the stored total feed length, stopped, and cut.

25 Claims, 40 Drawing Figures

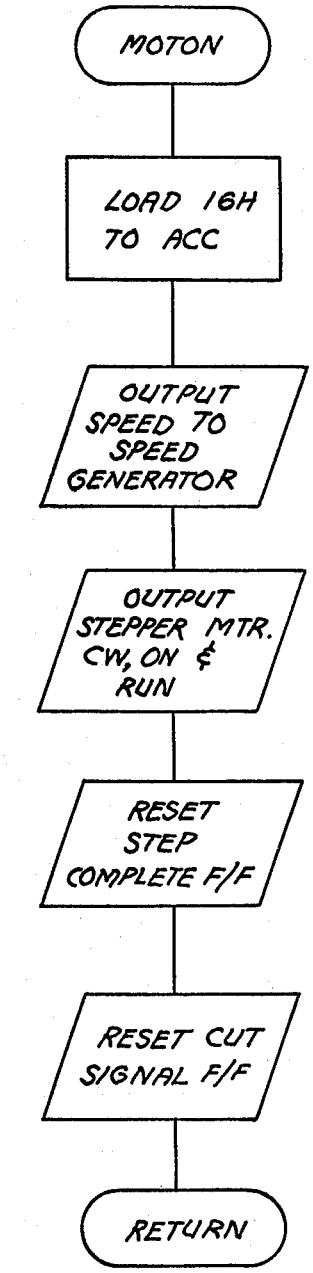
FIG. 16A
FIG. 21C
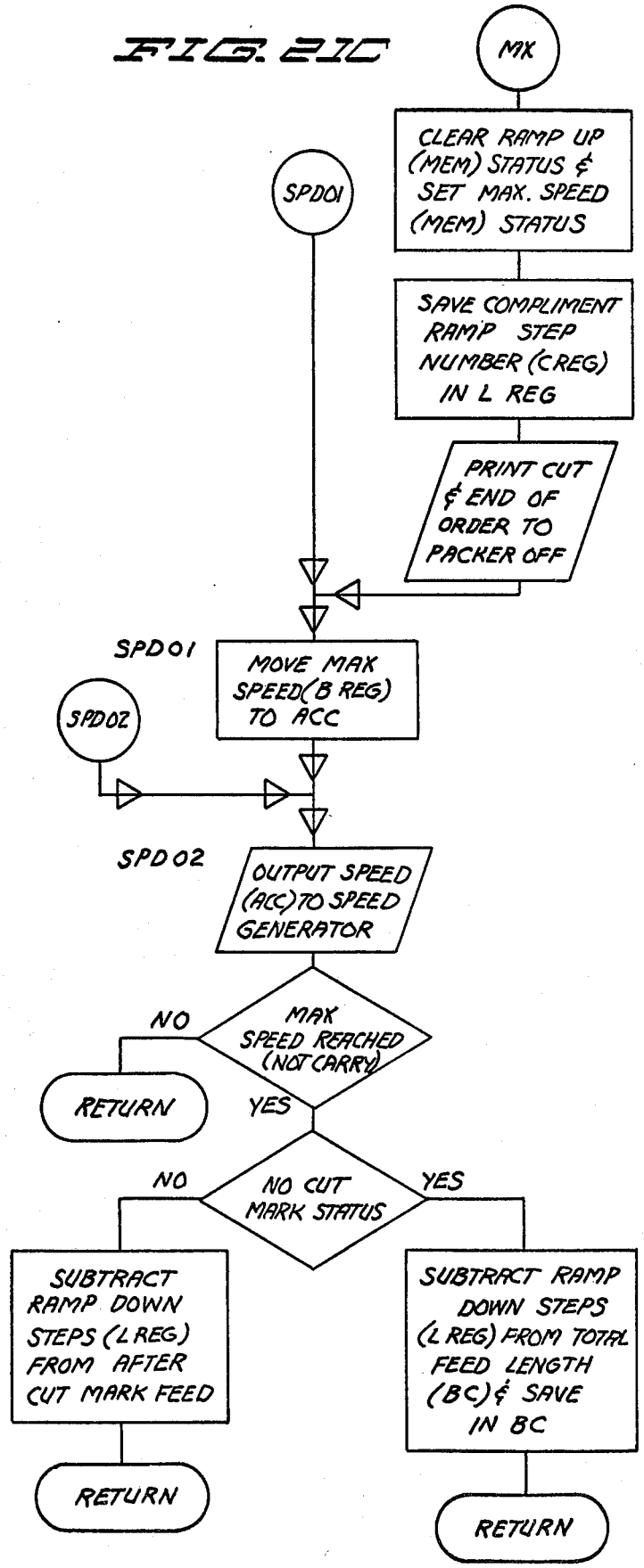

TEST 1

NO CUT MARK SELECTED
YES
RAMPD
NO
READY TO RAMP ON
YES
NO
AFTER CUT MARK
YES
END PR
NO
CUT MARK VALID
YES
NOCTM
NO
LOAD CUT WINDOW TO TEST COUNTER & SET CUT MARK VALID
CTCHK
RAMPD
RAMPD
CLEAR READY TO RAMP DOWN
GET NUMBER OF STEPS UNTIL END OF PRINT
NUMBER OF STEPS = Ø
YES
ENDPR
NO
CLEAR MAX SPEED
NO
CUT EARLY
YES
CUT SOLENOID ON
CTCHK

PHOTOGRAPHIC PAPER CUTTER WITH AUTOMATIC PAPER FEED IN THE EVENT OF OCCASIONAL MISSING CUT MARKS

This is a continuation, of application Ser. No. 837,999, filed Sept. 29, 1977, now abandoned.

REFERENCE TO CO-PENDING APPLICATIONS

Reference is made to the following co-pending patent applications and patents which are filed on even date with Ser. No. 837,999, of which this application is a continuation and are assigned to the same assignee as this application: Ser. No. 838,064, now U.S. Pat. No. 4,128,887 "Microprocessor Controlled Photographic Paper Cutter" by G. Strunc and F. Laciak Ser. No. 837,987, now U.S. Pat. No. 4,106,716; "Paper Drive Mechanism for Automatic Photographic Paper Cutter" by R. Diesch; Ser. No. 837,986, now U.S. Pat. No. 4,147,080 "Multichannel Indicia Sensor for Automatic Photographic Paper Cutter" by R. Diesch and G. Strunc; Ser. No. 837,988, now U.S. Pat. No. 4,156,170 "Stepper Motor Control" by G. Strunc; Ser. No. 838,065, now U.S. Pat. No. 4,123,649 "Print and Order Totalizer for Automatic Photographic Paper Cutter" by G. Strunc; and Ser. No. 838,000, now U.S. Pat. No. 4,150,711 "Paper Feed Control for Automatic Photographic Paper Cutter" by R. Diesch and G. Strunc. Subject matter disclosed but not claimed in the present application is disclosed and claimed in these co-pending applications.

BACKGROUND OF THE INVENTION

The present invention relates to photographic processing equipment. In particular, the present invention relates to an improved paper feed control system for use in an automatic photographic paper cutter.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. The cut marks indicate the desired location of a cut between adjacent prints. The end-of-order marks, which typically appear along the opposite edge of the print paper from the cut marks, indicate the end of a customer's order. The automatic paper cutter includes a sensor which senses the cut mark and causes the individual prints to be cut from the strip at the desired locations. The separated prints are passed to an order packaging or grouping device, which groups the prints in response to the end-of-order marks which are sensed by the automatic cutter.

The desire for high rates of processing within commercial photographic processing operations has led to the development of extremely high speed automatic paper cutters. Automatic paper cutters capable of cutting over 25,000 prints per hour (i.e. over 7 prints per second) are needed, and are being developed.

One obstacle to achieving the desired high speed operation in automatic paper cutters is the problem of missing cut marks. While the photographic printers which produce the cut marks are generally very reliable, occasionally a cut mark is either not made or is made improperly so that the cut indicia sensor does not sense a cut mark. As a result, an incorrect paper feed is produced. The operator generally must stop the automatic paper cutter, or the automatic paper cutter may stop automatically if no cut mark is sensed.

While this problem is present with lower speed automatic paper cutters, it becomes particularly important when extremely high speed operation is desired. Any stopping of the paper cutter, even for one minute, significantly reduces the output of a high speed automatic paper cutter.

SUMMARY OF THE INVENTION

The automatic paper feed control of the present invention overcomes the missing cut mark problem. The total feed length for the last previous paper feed-and-cut cycle in which cut indicia were sensed is stored and continuously updated with each paper feed-and-cut cycle. If a cut indicium is not sensed within a predetermined portion or "window" of a paper feed-and-cut cycle, the automatic paper feed control causes the paper to be advanced by a length determined by the stored total feed length, stopped, and cut.

In the preferred embodiments of the present invention, the paper feed-and-cut cycles are terminated after a predetermined number of consecutive cycles in which cut indicia are not sensed. As a result, if one or two cut marks are not present, the operation of the automatic paper cutter is not halted. The variation in print length of adjacent prints is generally very slight, so that cuts made for one or two cycles using the stored total feed length are accurate.

The automatic paper feed control of the present invention, therefore, permits high speed operation of an automatic paper cutter without interruption and loss of productivity because of an occasional missing cut mark. This provides a significant improvement in the output of high speed automatic paper cutters, since any interruption in the operation of a high speed automatic paper cutter results in a significant loss of productivity.

BRIEF DESCRIPTION OF THE DRAWINGS

FIG. 1 is a perspective view of an automatic paper cutter utilizing the present invention.

FIG. 3 is an electrical block diagram of the automatic paper cutter of FIG. 1.

FIG. 8 is an electrical schematic diagram of the programmable input/output (I/O) device shown in FIG. 4.

DETAILED DESCRIPTION OF THE PREFERRED EMBODIMENTS

Introduction

Figure 7:
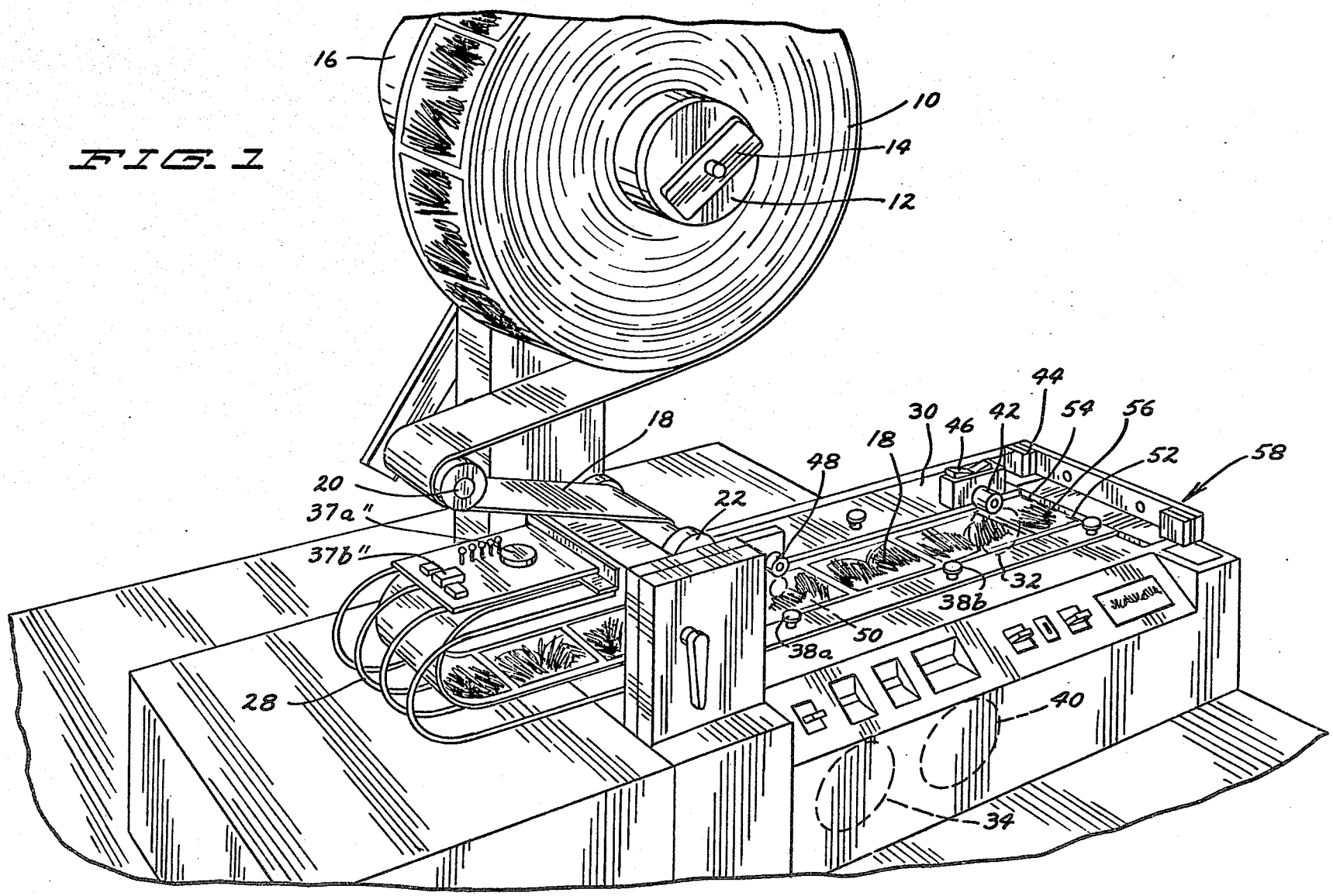
FIG. 7 is an electrical schematic diagram of a portion of the paper cutter control of FIG. 4 including read-only memories and associated memory select circuitry.

The automatic paper feed of the present invention controls the feed length of a print in an automatic paper cutter in the event that the cut mark is missing. If a cut mark is not sensed within a "window" in which it would normally appear, the automatic paper feed of the present invention causes the photographic paper strip to be advanced by a length determined by the total feed length of the last previous paper feed-and-cut cycle in which cut marks were sensed at both ends. The present invention is based upon the assumption that variation in print length of adjacent prints is generally very slight, so that cuts made for one or two cycles using the stored total feed length of the last previous cycle in which cut marks were sensed will be sufficiently accurate. If cut marks are not sensed for more than a predetermined number of cycles (preferably two or three), the automatic paper cutter is stopped. If more than two consecutive cut marks are missing, there is a relatively high likelihood that something is wrong with the photographic paper or with the automatic paper cutter which justifies stopping the automatic paper cutter to allow the operator to identify the problem. On the other hand, a single missing cut mark followed by a correctly sensed cut mark is normally not sufficient cause to stop the automatic paper cutter.

The present invention, therefore, represents an important improvement to automatic paper cutters, since an occasional missing cut mark does not result in an erroneous paper feed and does not result in stopping of the automatic paper cutter. With the advent of high speed automatic paper cutters, any unnecessary interruption in the operation of the paper cutter represents a significant loss in productivity. Unnecessary interruptions due to an occasional missing cut mark are eliminated with the present invention.

The automatic paper feed with provision for occasional missing cut marks has been used to considerable advantage in a high speed, microprocessor controlled, automatic paper cutter in which as many as 25,000 3½ inch long prints are cut per hour. The present invention, therefore, will be described in the context of this high speed, microprocessor controlled, automatic paper cutter.

The automatic paper cutter described in the following sections utilizes a paper feed control which is described in the previously mentioned co-pending application Ser. No. 838,000 entitled "Paper Feed Control for Automatic Photographic Paper Cutter" by R. Diesch and G. Strunc. In the paper feed control described in this co-pending application, a cut indicia sensor is positioned in fixed relationship with the knife assembly at a distance less than the shortest print to be cut. A feed-after-sense signal, which indicates the distance which the print must be advanced after a cut mark is sensed, is derived and stored. During a paper feed-and-cut cycle, the paper is advanced until a cut mark is sensed and then advanced by an additional distance determined by the feed-after-sense signal.

Although the present invention is used to advantage in conjunction with the paper feed control described in the co-pending application, it will be clear to workers skilled in the art that the present invention may also be used in conjunction with automatic paper cutters having different paper feed controls. The present invention is concerned with an alternative control of paper feed length in the event of an occasional missing cut mark and, therefore, can be used in conjunction with paper feed control systems other than the system specifically described and claimed in the previously mentioned co-pending application.

The following section, which is entitled "System Overview", generally describes the operation of a high speed, microprocessor controlled, automatic paper cutter which utilizes the present invention. The following section entitled "Electrical System Description" describes those portions of the electrical control system of the automatic paper cutter which pertain to the present invention. Finally, the section entitled "Automatic Paper Feed Operation in the Event of Missing Cut Marks" describes the operation of the present invention with reference to the various electrical circuits shown in the Figures and to operation flow charts and assembler listings which describe the operations of the microprocessor which pertain to the present invention.

A complete description of the electrical control system of the automatic paper cutter may be found in the previously mentioned co-pending application Ser. No. 838,064 entitled "Microprocessor Controlled Automatic Paper Cutter" and a more detailed description of the paper supply and drive system may be found in the previously mentioned patent application Ser. No. 838,987 entitled "Paper Drive Mechanism for Automatic Photographic Paper Cutter". The other co-pending applications referred to in the "Reference to Co-pending Applications" also describe various aspects of the automatic paper cutter shown in the Figures. The following description describes in detail the present invention and describes other subsystems and components of the automatic photographic paper cutter only in that detail required for understanding of the present invention.

Paper Cutter System Overview

FIG. 1 is a perspective view of a high speed, microprocessor controlled, automatic paper cutter which utilizes the automatic paper feed of the present invention to overcome the problem of occasional missing cut marks. The paper cutter includes five major portions: a paper supply, a paper drive mechanism, a knife assembly, main and auxiliary control panels, and control electronics.

The paper supply is an integral part of the paper cutter. A paper roll 10 is loaded from the front on to hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown), into wire form retainer 28, and then to paper guides 30 and 32 of the paper drive mechanism. The drive pinch roller is driven by the same AC motor 34 which drives the knife assembly of the paper cutter. The motor 34 drive is transmitted to the drive pinch roller through a belt drive and electro-mechanical clutch 36 (shown schematically in FIG. 4). When the proper loop is generated, clutch 36 is de-energized and brake 16 is energized to prevent paper from unspooling off roll 10.

The paper drive mechanism includes paper guides 30 and 32, which receive paper strip 18 from the paper supply assembly. Rear guide 30 is fixed and front guide 32 is movable so that various paper widths can be accomodated. Front paper guide 32 is adjusted by loosening thumbscrews **38*a* and 38*b* and moving front guide 32** to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Cut marks sensed by front or rear sensor assemblies 52 or 54 are used to indicate the location of a desired paper cut.

Knife assembly 58 includes a base, a spring-wrap clutch mechanism 60 (shown schematically in FIG. 4), AC motor 34 (which also drives the drive pinch roller of the paper supply), a main drive shaft, two crank arm assemblies, two vertical drive shafts, and interchangeable blades. One blade is used for cutting straight-bordered and straight-borderless prints, and the other blade is used for cutting round-cornered borderless prints.

Figure 2:
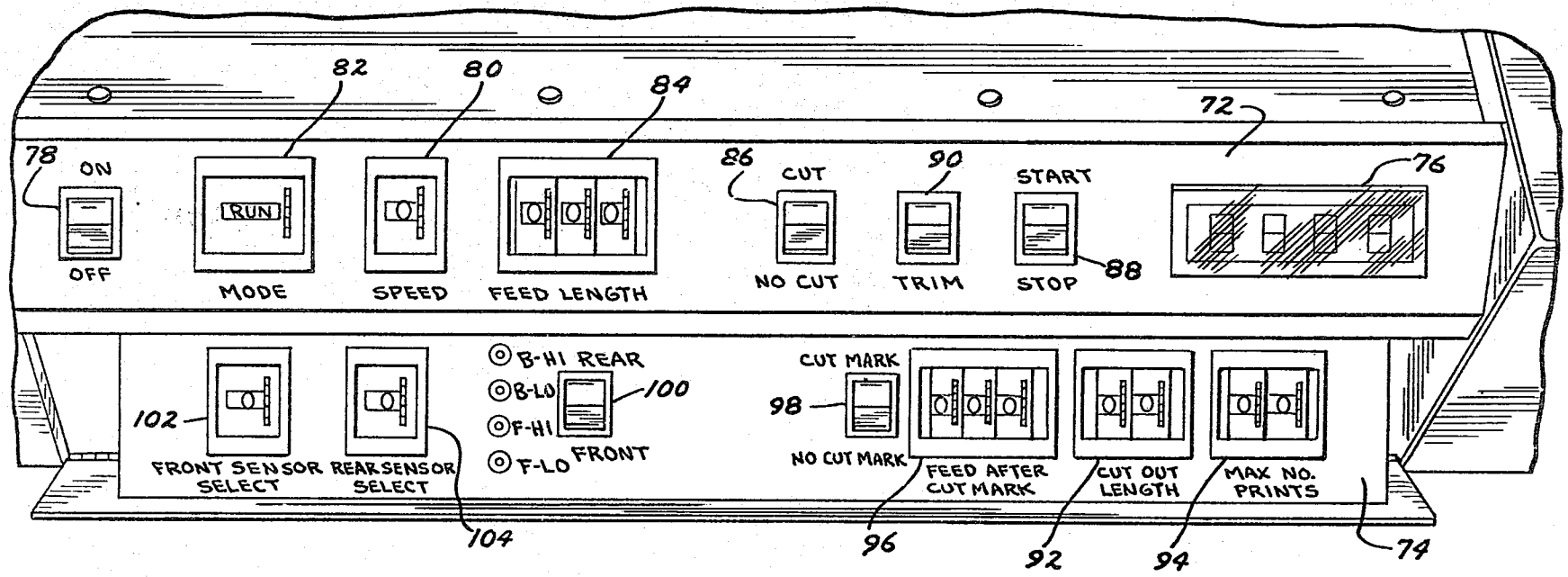
FIG. 2 shows the main and auxiliary control panels of the automatic paper cutter of FIG. 1.

FIG. 2 shows the main and auxiliary control panels 72 and 74. Main control panel 72, which is located at the front of the paper cutter, has a display 76 and seven switches. These seven switches are Power switch 78, Speed Select switch 80, Mode Select switch 82, Feed Length switch 84, Cut/No Cut switch 86, Start/Stop switch 88, and Trim switch 90.

The remaining seven switches of the automatic paper cutter are located on auxiliary panel 74, which is located below main control panel 72 and is accessible through a hinged cover. The seven switches are Length of Cutout switch 92, Maximum Number of Prints switch 94, Feed-After-Cut-Mark switch 96, Cut Mark-/No Cut Mark switch 98, Front/Rear Cut Sensor switch 100, Front Sensor Select switch 102, and Rear Sensor Select switch 104.

The automatic paper cutter operation is commenced by turning on Power switch 78. Front paper guide 32 is then set to the appropriate paper width, paper roll 10 is installed on hub 12, and paper strip 18 is threaded through the paper supply and into the paper cutter.

The operator then selects the proper sensor assembly (either front sensor 52 or rear sensor 54) to sense cut marks by switching Front/Rear Cut Sensor switch 100 to the "Front" or the "Rear" position. The sensor assembly which is not selected is automatically used to sense end-of-order marks, which appear along the opposite edge of paper strip 18 from the cut marks.

The next step involves selecting a proper segment of the sensor assembly so that the largest sensor signal is provided. Mode switch 82 is placed in the SENSOR SELECT mode, and a portion of print paper strip 18 bearing a cut mark or end-of-order mark is oscillated back and forth past the sensor assembly. The operator sets the Front and Rear Sensor Selector switches 102 and 104 to the settings which select the proper segments of sensor assemblies 52 and 54 so that the largest sensor signals are provided.

Mode switch 82 is then set to the FEED LENGTH CALIBRATE mode, Start switch 88 is actuated and one print is fed from cut mark to cut mark. The feed length is displayed on display 76 and that value is set into Feed Length switch 84 by the operator.

The operator then sets Mode switch 82 to the FEED-AFTER-SENSE mode. The edge of a print is aligned with a calibration mark on one of the paper guides 30 and 32. Start switch 88 is actuated and the paper advances to the next cut mark and stops. The feed-after-sense length is displayed on display 76, and the operator sets that value into Feed-After-Sense switch 96.

The operator then sets Mode switch 82 to the RUN mode and sets Speed switch 80 to the desired cycle rate. If bordered or round-cornered borderless prints are being cut, the paper cutter is then ready to operate. If straight borderless prints are being cut, the length of cutout must be set in Length of Cutout switch 92.

Automatic operation of the paper cutter can then be commenced by actuating Start switch 88. At the end of a shift or the end of a day, summary modes are available in which the total prints cut and total orders cut during that shift or that day are displayed on display 76.

Electrical System Description

FIG. 3 is an electrical block diagram of the automatic photographic paper cutter. As shown in FIG. 3, power supply 150 supplies power to the various circuits and motors contained in the paper cutter. Power supply 150 is controlled by Power switch 78.

Paper cutter control 154 controls the operation of the paper cutter. Paper cutter control 154 receives inputs from the various switches of main control panel 72 and auxiliary panel 74 through control panel logic circuit 156. In addition, signals from reject/remake sensor 158, front indicia sensor 52 and rear indicia sensor 54 are processed by sensor amplifier circuit 160 and supplied through auxiliary panel 74 and control panel logic 156 to paper cutter control 154. Paper cutter control 154 also may receive inputs from optional foot switch 162 and print packer 164. Foot switch 162 is connected in parallel with the start contacts of start/stop switch 88 of main control panel 72 and allows the operator to initiate a feed-and-cut cycle without the use of hands. Packer 164 may be a photographic print sorter and packer such as the PAKOMP II photopacker manufactured by PAKO Corporation. If the paper cutter is to be used in conjunction with packer 164, interconnection is necessary in order to coordinate the operation of the two devices.

The outputs of paper cutter control 154 control the operation of stepper motor 40. Control of AC motor 34 is achieved by means of knife clutch 60, paper clutch/-brake driver assembly 166, paper brake 16, and paper clutch 34. Paper cutter control 154 also supplies signals to control panel 72, and supplies output signals to packer 164 if the paper cutter is being used in conjunction with packer 164.

Figure 4:
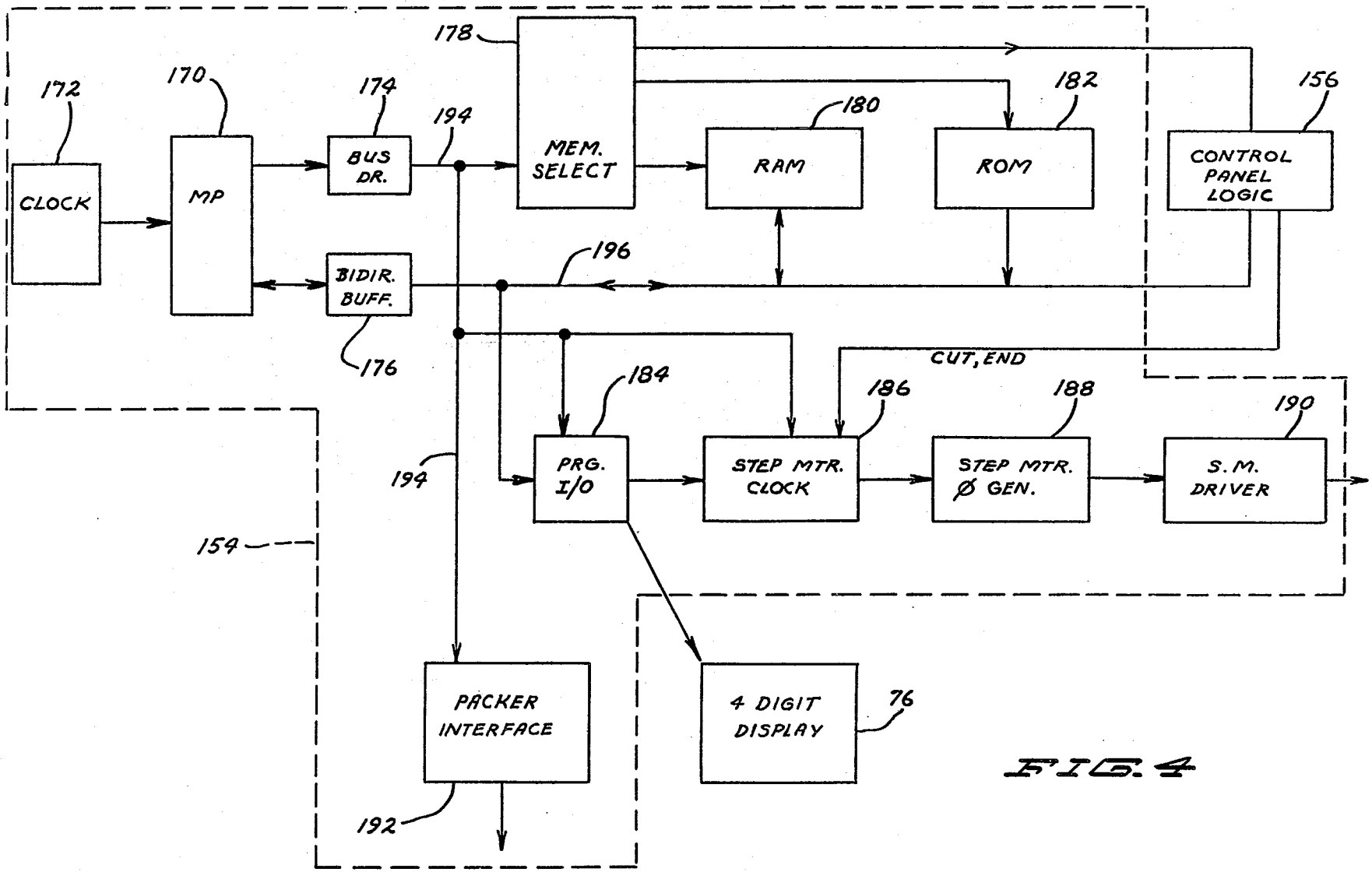
FIG. 4 is an electrical block diagram of the paper cutter control shown in FIG. 3.

FIG. 4 shows an electrical block diagram of paper cutter control 154. The paper cutter control includes microprocessor 170, clock 172, bus driver 174, bidirectional buffer 176, memory select circuit 178, random access memory (RAM) 180, read-only memory (ROM) 182, programmable input/output (I/O) device 184, stepper motor clock 186, stepper motor phase generator 188, stepper motor driver 190, and packer interface circuit 192.

In one preferred embodiment, microprocessor 170 is an 8-bit microprocessor such as the Intel 8080A. Clock circuit 172 supplies clock signals, together with some other related signals, to microprocessor 170. Bus driver 174 receives outputs from microprocessor 170 and drives various lines of address bus 194. Memory select circuit 178 receives the signals from address bus 194 and addresses selected locations of RAM 180 or ROM 182. In addition, memory select circuit 178 may address the control panel logic 156 shown in FIG. 3 to interrogate the various switches of main and auxiliary control panels 72 and 74. In the system shown in FIG. 4, the switches of main and auxiliary panels 72 and 74 are addressed in the same manner as a memory location. Data to and from RAM 180 and data from ROM 182 and control panel logic 156 is supplied over data bus 196. Bidirectional buffer 176 interconnects microprocessor 170 with data bus 196.

Programmable I/O device 184 is also connected to data bus 196 and receives data from microprocessor 170. This data is used to control operation of stepper motor 40 through stepper motor clock 186, stepper motor phase generator 188, and stepper motor driver 190. In addition to the output signals from programmable I/O device 184, stepper motor clock receives the CUT and END signals from control panel logic 156.

Programmable I/O device 184 also controls the operation of display 76. Depending upon the particular mode selected by mode switch 82 on main control panel 72, display 76 may display the feed length, the feed-after-sense length, the number of prints in the previous order, the total number of prints since the cutter was turned on, or the total number of orders since the cutter was turned on.

As shown in FIG. 4, packer interface circuit 192 is also connected to address bus 194. Packer interface circuit 192 supplies the necessary signals to packer 164 of FIG. 3 to coordinate the operation of packer 164 with the operation of the automatic paper cutter.

Figure 5:
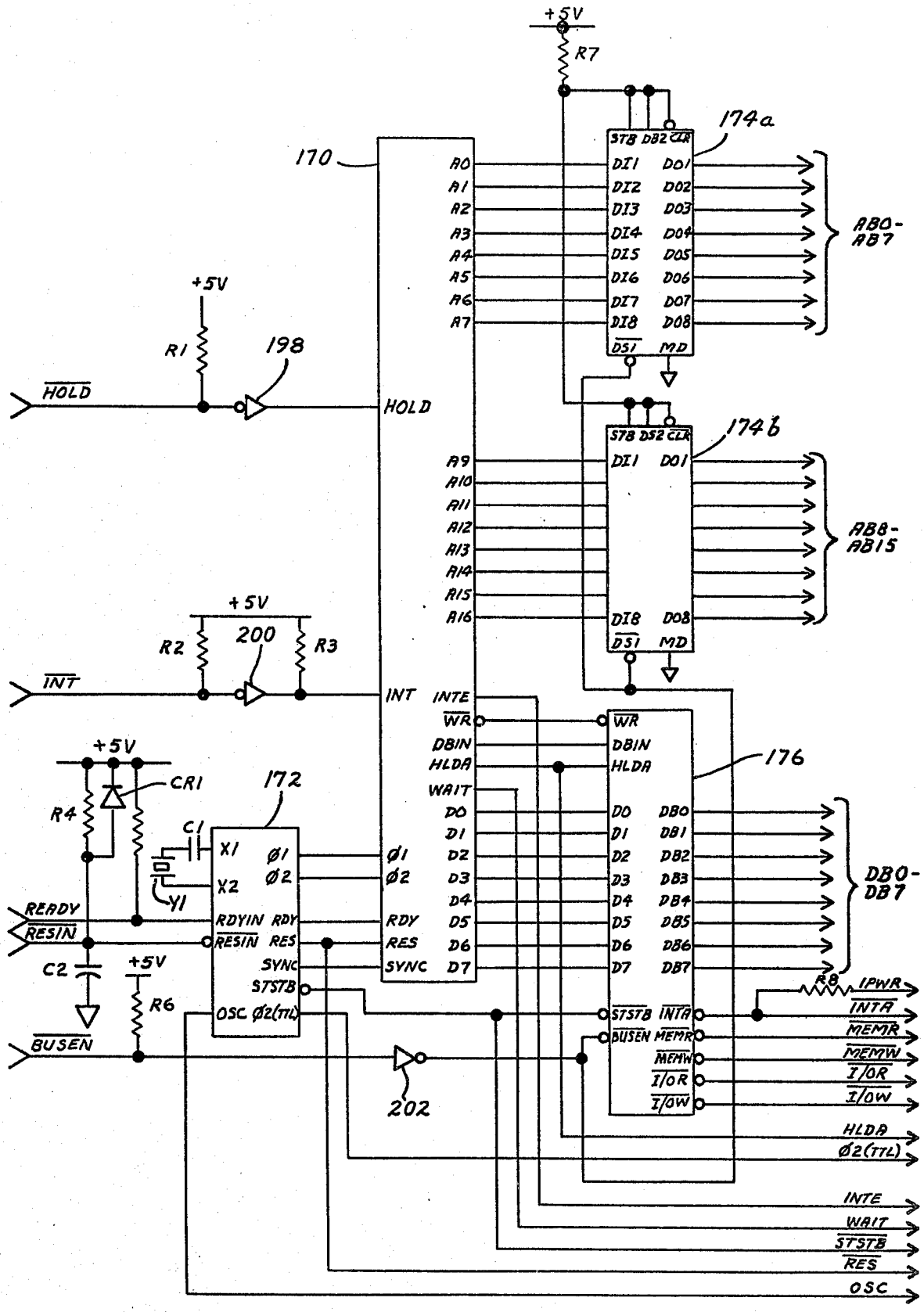
FIG. 5 is an electrical schematic diagram of a portion of the paper cutter control of FIG. 4 including a microprocessor, a clock, bus drivers, and a bidirectional buffer.

FIG. 5 shows a portion of cutter control 154 including microprocessor 170, clock 172, bus drivers 174*a* and 174*b*, and bidirectional buffer 176. Also included in the circuit of FIG. 8 are resistors R1-R8, capacitors C1 and C2, diode CR1, and inverters 198, 200, 202, and 204.

Clock 172, which is one preferred embodiment is an Intel 8224 integrated circuit, provides the $\phi 1$ and $\phi 2$ clock signals to microprocessor 170. The frequency of the $\phi 1$ and $\phi 2$ clock signals is determined by oscillator crystal Y1 and capacitor C1. In one preferred embodiment, crystal Y1 is selected to provide an 18.432 MHz oscillation.

In addition to the $\phi 1$ and $\phi 2$ clock signals, clock generator 172 also provides the RDY, RES, and SYNC signals to microprocessor 170, the $\overline{\text{STSTB}}$ signal to bidirectional buffer 176, and the $\phi 2$ (TTL) and OSC signals to other circuits within cutter control 154.

In addition to the signals supplied by clock 172, microprocessor 170 receives the HOLD signal from inverter 198 and the interrupt (INT) signal from inverter 200. The outputs of microprocessor 170 include address lines A0-A15, which are supplied to bus drivers 174*a* and 174*b*. The outputs of bus drivers 174*a* and 174*b* are address bus lines AB0-AB15, which form a 16 line address bus 194. Bus drivers 174*a* and 174*b* are enabled by the BUSEN signal from inverter 202.

Data lines DB0-DB7 of data bus 196 are connected to bidirectional buffer 176, which permits bidirectional flow of data on data bus 196 to and from microprocessor 170. In addition, bidirectional buffer 176 generates the $\overline{\text{INTA}}$, IPWR, $\overline{\text{MEMR}}$, $\overline{\text{MEMW}}$, $\overline{\text{I/OR}}$, and $\overline{\text{I/OW}}$ signals which determine the direction of flow of data on data bus 196 and control the operation of the various circuits connected to data bus 196.

The remaining signals generated by the circuit shown in FIG. 5 are generated by microprocessor 170. These signals are the HLDA, INTE, and WAIT signals.

Figure 6:
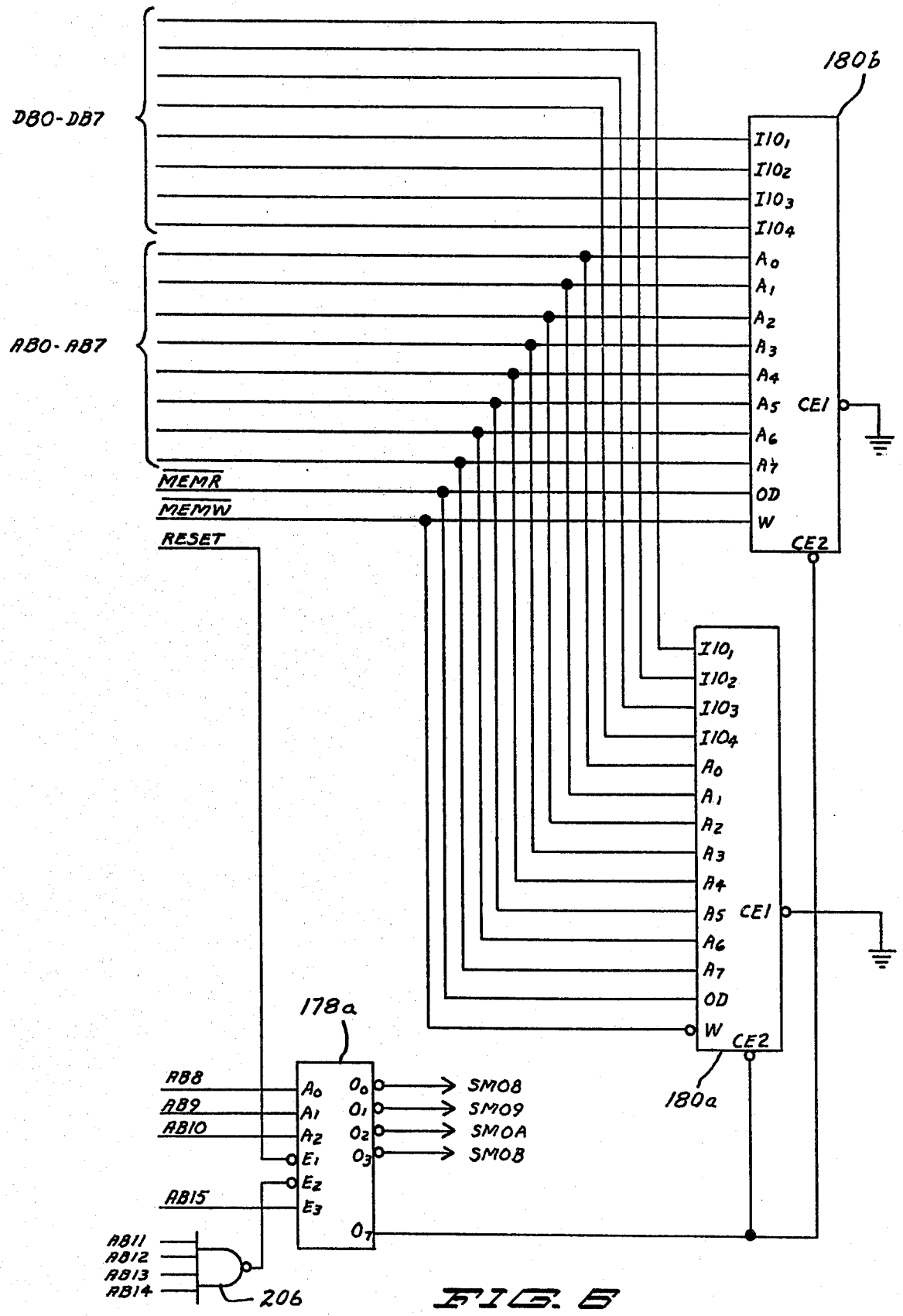
FIG. 6 is an electrical schematic diagram of a portion of the paper cutter control of FIG. 4 including random access memories and associated memory select circuitry.
Figure 7:
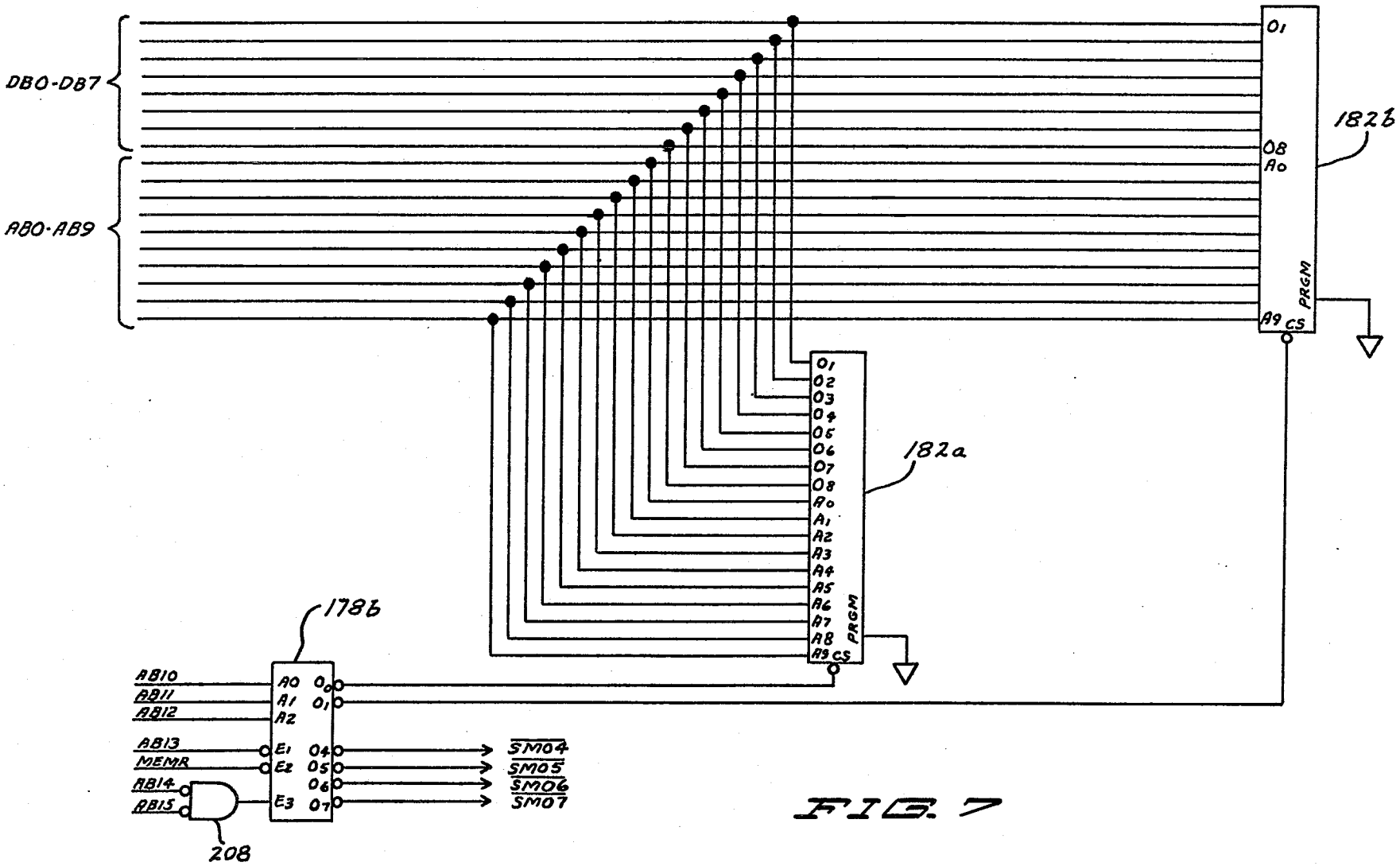

FIG. 6 shows random access memories 180*a* and 180*b*, together with NAND gate 206 and memory select circuit 178*a*. In a preferred embodiment, random access memories 180*a* and 180*b* are Intel 8111-1 integrated circuits and memory select 178*a* is an Intel 8205 integrated circuit.

Depending upon the states of address bus lines AB8-AB15, memory select 178*a* provides an enable signal to either RAM 180*a* or 180*b*, or will generate an enable signal on lines SMO8, SMO9, SMOA, or SMOB.

If either RAM 180*a* or RAM 180*b* is selected, data will either be written into or road from memory locations of the RAM. The state of the $\overline{\text{MEMW}}$ signal, which is supplied to the W inputs of RAMs 180*a* and 180*b* determines whether data is written or read.

As shown in FIG. 6, the random access memory includes only two RAM integrated circuits 180*a* and 180*b*. If further storage is required, as many as six additional RAM integrated circuits may be connected and addressed by memory select 178*a*. In the embodiment of the automatic paper cutter described in the present application, however, two RAM integrated circuits is sufficient to provide the necessary storage.

FIG. 7 shows ROMs 182*a* and 182*b*, memory select circuit 178*b*, and NAND gate 208. Memory select circuit 178*b* enables either ROM 182*a* or 182*b* depending upon the state of address bus lines AB10-AB15 and the $\overline{\text{MEMR}}$ signal. In addition, memory select circuit 178*b* produces the $\overline{\text{SMO4}}$ -$\overline{\text{SM07}}$ signals.

In a preferred embodiment, ROMs 182*a* and 182*b* are erasable programmable read-only memories (EPROM) such as the Intel 8708. When either ROM 182*a* or 182*b* is enabled, address bus lines AB0-AB9 select the particular memory location, and data read from that location is supplied on data bus lines DBO-DB7.

As in the case of the random access memory shown in FIG. 6, the read-only memory of FIG. 7 may include additional memory circuits if additional storage is required. With the configuration shown in FIG. 7, two additional intel 8708 EPROMs may be added without requiring additional memory select circuitry.

FIG. 8 shows programmable I/O device 184 together with NAND gates 210 and 212 and inverter 214. In a preferred embodiment, programmable I/O device 184 is an Intel 8255 integrated circuit and NAND gates 210 and 212 and inverter 214 are TTL logic gates. Except where otherwise specifically indicated, all logic gates shown in the Figures are CMOS integrated circuit devices.

Programmable I/O device 184 receives data bus lines DB0-DB7, address bus lines AB0 and AB1, and the $\overline{I/OW}$, $\overline{I/OR}$ and RES lines. In addition, address bus lines AB2 and AB3 and NANDed by NAND gate 210, whose output is NANDed with address bus line AB13 by NAND gate 212. The output of NAND gate 212 is inverted by inverter 214 and supplied to the $\overline{CS}$ input of programmable I/O device 184.

Programmable I/O device 184 has two 8-line outputs. The first set of 8 outputs, which are designated PA0-PA7, are supplied to the inputs of stepper motor clock generator 186. The 8-bit number supplied on lines PA0-PA7 is used to control the frequency of the output of the stepper motor clock generator 186, and, therefore, the speed of stepper motor 40.

The PBO-PB7 outputs from programmable I/0 device 184 are supplied to the main control panel 72. Lines PB0-PB7 are decoded and are used to drive display 76.

Figure 9:
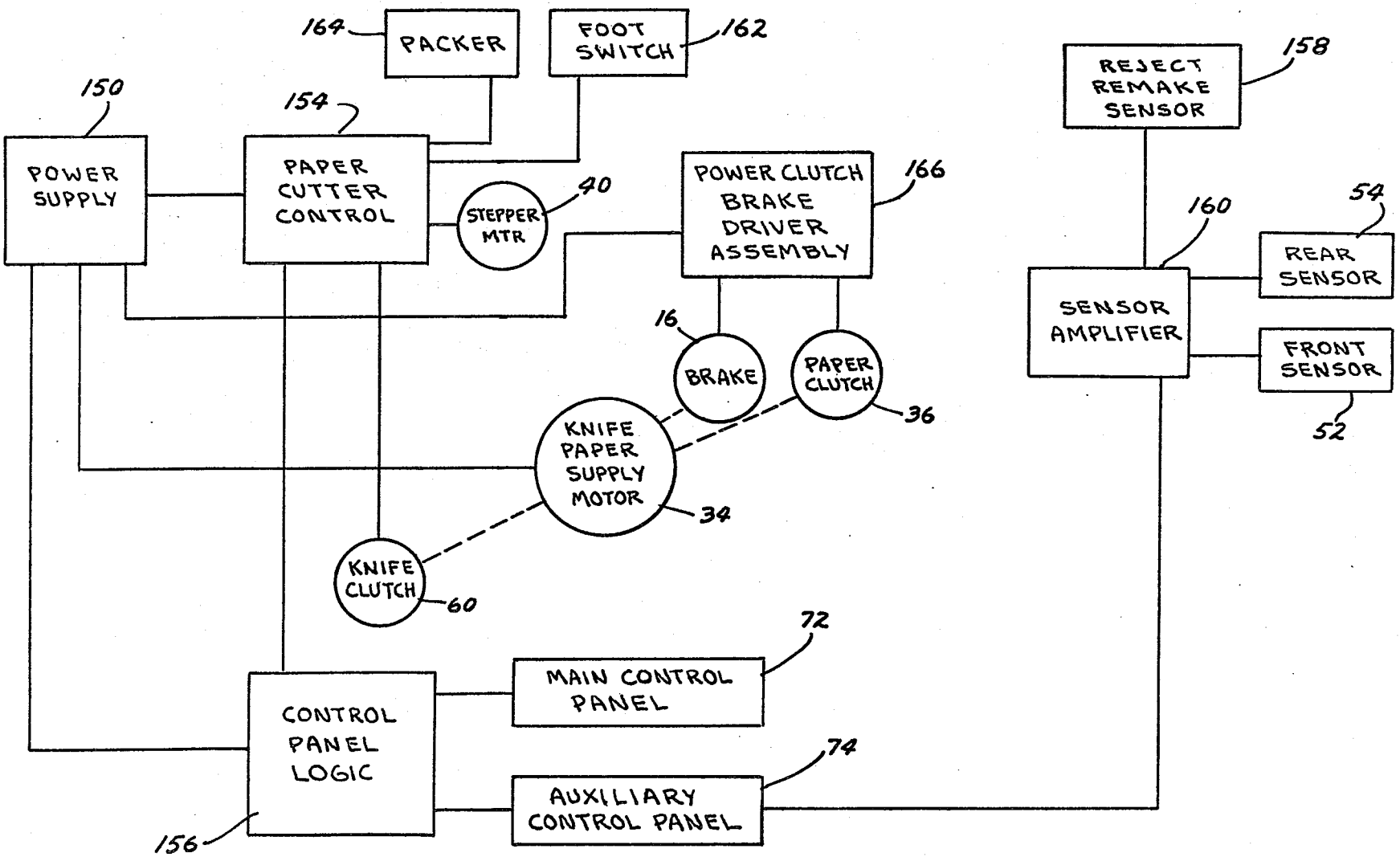
FIG. 9 is an electrical schematic diagram of the packer interface shown in FIG. 4.

FIG. 9 shows circuitry which is primarily the packer interface 192 as shown in FIG. 4. This circuitry is used to provide the necessary signals to packer 164 shown in FIG. 3 in order to coordinate the operation of the automatic paper cutter with packer 164.

The interface circuitry of FIG. 9 includes an 8-bit adjustable latch 216, TTL NAND gates 218 and 220, and driver circuits 222, 224, 226, and 228 for producing the P SORT MARK + and −, ADVANCE COMPLETE + and −, END OF ORDER + and −, PRINT CUT + and − signals which are supplied to packer 164. In addition, FIG. 9 includes circuit 230 which receives the START + and − signals from packer 164 and supplies the START signal to control panel logic 156. Finally, FIG. 9 includes driver circuit 232 which produces the CTSEG signal which energizes the cutter knife.

The A0, A1, and A2 inputs of latch 216 receive the AB8, AB9, and AB10 address bus lines. The D input of latch 216 is connected to AB11, the R input receives the $\overline{RES}$ signal, and the E input receives an enable signal which results from the NANDing of $\overline{I/OW}$, AB12, and AB14 by NAND gates 218 and 220.

The Q0 output of latch 216 is supplied through resistor R9 to stepper motor driver 190 as the OFF - signal. The Q1 output of latch 216 is the CTSON signal which is supplied to driver circuit 232. When the CTSON and LPP12 signals are high and the CUT signal is low, driver circuitry 232 provides the CTSEG signal which controls the operation of the cutter knife assembly.

Outputs Q2-Q5 of latch 216 are used to generate signals for packer 164. The Q2 output is supplied to driver circuit 222, which generates the P SORT MARK + and P SORT MARK − signals. Driver circuit 222 also receives the RRS signal from sensor amplifier 160. The RRS signal is high if reject/remake sensor 158 senses a mark on a print indicating that the print is a reject or a remake print.

The Q3 output of ltach 216 is supplied to driver circuit 224 which provides the ADVANCE COMPLETE + and ADVANCE COMPLETE − signals to packer 164. Similarly, the Q4 output is supplied to driver circuit 226, and a Q5 output is supplied to driver circuit 228. Driver circuit 226 supplies the END OF ORDER + and END OF ORDER − signals to packer 164, while driver circuit 228 supplies the PRINT CUT + and PRINT CUT − signals to packer 164.

Circuit 230 shown in FIG. 9 receives the START + and START − signals from packer 164 and generates a START signal which is supplied to control panel logic 156. The START signal allows packer 164 to initiate a paper feed-and-cut cycle independent of start switch 88 on main control panel 72.

FIGS, 10A and 10B show stepper motor clock 186, which produces the SMTRCK and SMCW signals. The SMTRCK signal is a stepper motor clock signal, and each pulse of the SMTRCK signal corresponds to one step of stepper motor 40. The SMCW signal determines whether stepper motor will be driven clockwise or counterclockwise. Both the SMTRCK and SMCW signals are provided to stepper motor phase generator 188.

The frequency of the SMTRCK signal is determined by inuts PA0-PA7, which are received from programmable I/O device 184. These inputs represent a two-digit binary coded decimal (BCD) number. Inputs PAO-PA3 represent the least significant bit, and PA4-PA7 represent the most significant bit. BCD rate multiplier 234 receives inputs PA0-PA3, and BCD rate multiplier 236 receives inputs PA4-PA7. The two-digit BCD numbers supplied to rate multipliers 234 and 236 represent the number of output pulses produced by the O output of rate multiplier 234 per one hundred clock pulses from flipflop 238. In the embodiment shown in FIGS. 10A and 10B, flipflop 238 receives the $\phi 2$ signal which has a frequency of 2MHz from clock 172 and divides the frequency in half to produce a 1MHz clock signal. In addition to supplying the 1MHz signal to rate multipliers 234 and 236, flipflop 238 also supplies the signal to the clock input of counter 240, which divides the frequency to generate other needed clock frequencies.

The $\overline{RES}$ signal, which is low when power is turned on, is inverted by TTL inverter 242. The RES signal, which is the output of inverter 242, is supplied to the S9 inputs of rate multipliers 234 and 236 to enable them.

The output of rate multiplier 234 is a pulse signal. The number of pulses per one hundred clock pulses is determined by the BCD number supplied on lines PA0-PA7. This number may vary from 0 to 99.

The output of rate multiplier 234 is supplied to a smoothing circuit 244 formed by OR gates 246 and 248, counters 250, and 252, NAND gate 254, and inverter buffer 256. The output of smoothing circuit 244 is the SMTRCK signal. The purpose of smoothing circuit 244 is to smooth variations in spacing between output pulses of rate multiplier 234. The SMTRCK signal is a signal whose spacing between pulses is relatively uniform and whose frequency is determined by the BCD inputs to rate multipliers 234 and 236.

Figure 10A:
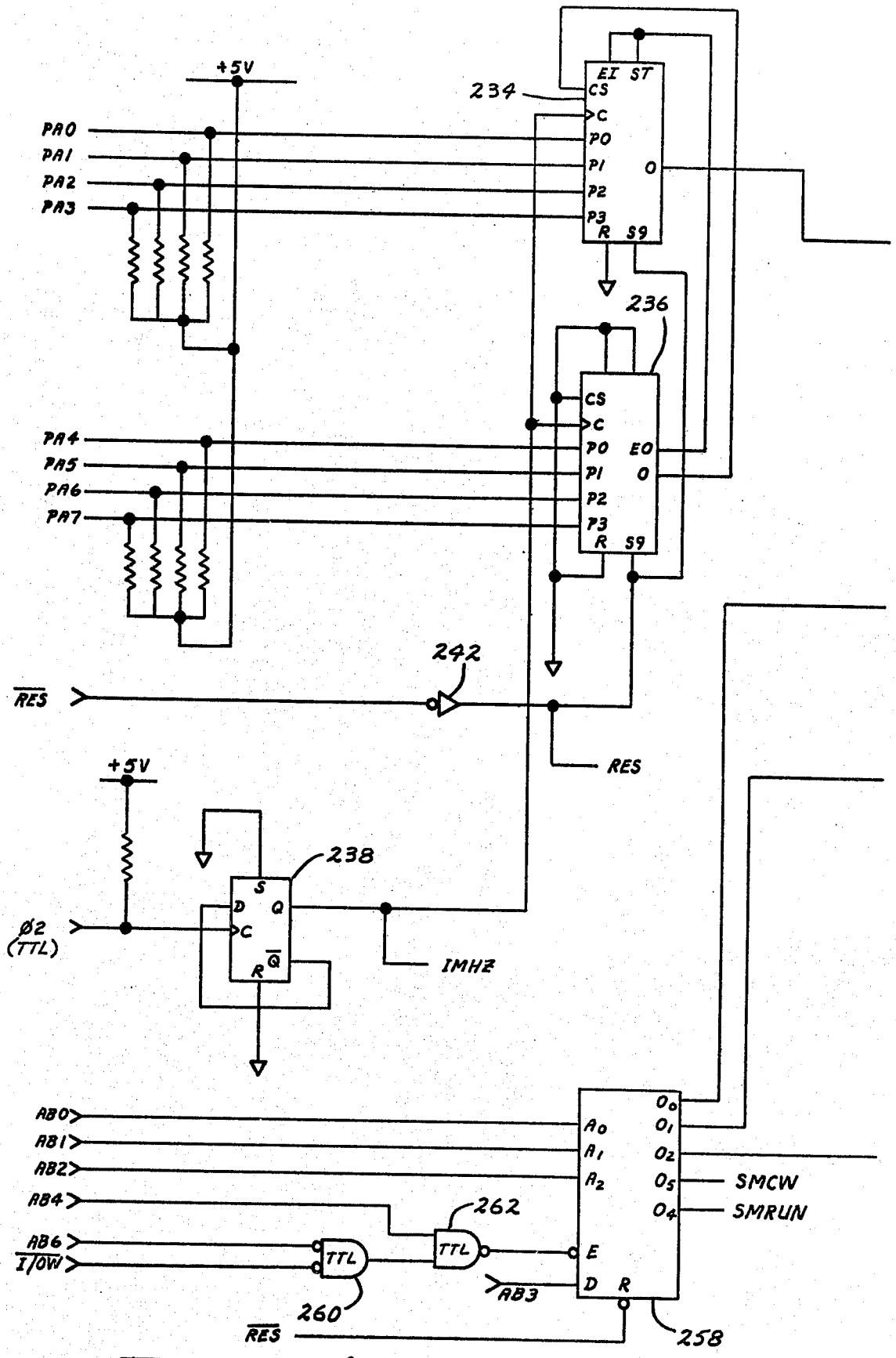
FIGS. 10A and 10B are an electrical schematic diagram of the stepper motor clock shown in FIG. 4.
Figure 10B:
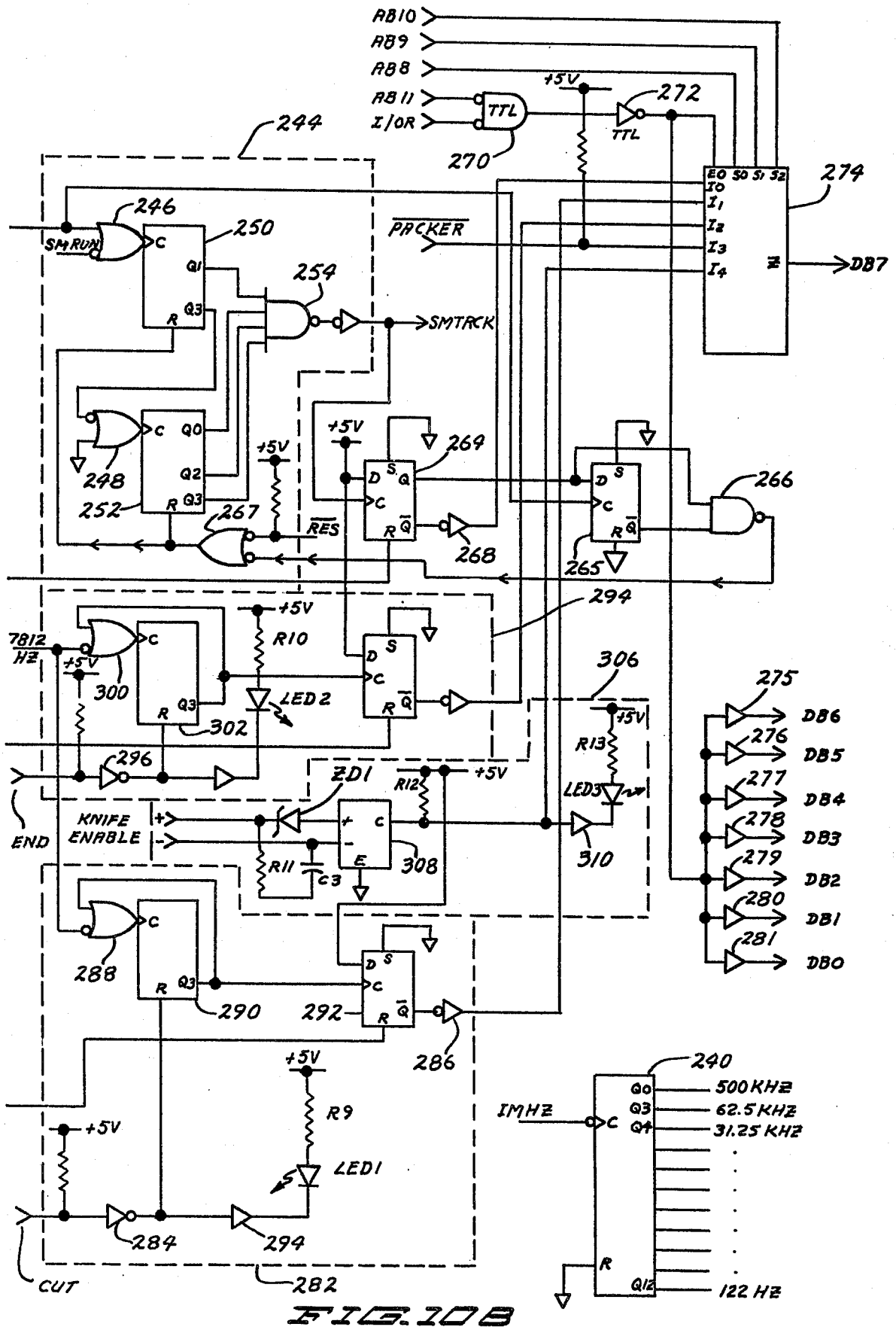

It can be seen that stepper motor clock 186 shown in FIGS. 10A and 10B permits control of the frequency of the SMTRCK signal and, therefore, control of the speed of stepper motor 40 by microprocessor 170. The desired values for the BCD inputs to rate multipliers 234 and 236 are preferably stored in "lookup tables". These lookup tables contain numbers which control the maximum frequency of the SMTRCK signal, as well as a set of frequencies used to generate an up ramp in frequency at the beginning of stepper motor operation or a down ramp in frequency at the end of stepper motor operation.

The remaining circuitry shown in FIGS. 10A and 10B allows microprocessor 170 to monitor status of a number of important signals and a control generation of the SMTRCK as a function of the status of these signals. The first portion of this circuitry includes 8-bit adjustable latch 258, TTL NAND gates 260 and 262, flipflops 264 and 265, NAND gate 266, NOR gate 267, and inverter 268. Latch 258 is enabled when AB4 is high, AB6 and I/$\overline{\text{OW}}$ are low, and power is on so that the reset signal ($\overline{\text{RES}}$) is low. The output states of latch 258 are determined by address bus lines AB0-AB3.

The $O_0$ and $O_4$ outputs of latch 258 directly control the production of the SMTRCK signal. The $O_4$ output is the SMRUN signal, which is supplied to the inverting input of OR gate 246 and which must be high for the SMTRCK signal pulses to be produced.

When a SMTRCK signal pulse is produced, it clocks flipflop 264 and causes the $\overline{Q}$ output of flipflop 264 to go low. This causes a high reset signal to be supplied to counters 250 and 252 by NOR gate 266. Further SMTRCK pulses are inhibited, therefore, until the $O_O$ output of latch 258 resets flipflop 264. The stepper motor clock, therefore, produces only one pulse at a time and microprocessor 170 must cause flipflop 264 to be reset before the next SMTRCK pulse (and therefore the next stepper motor step) is produced.

Microprocessor 170 periodically interrogates the status of flipflop 264, as well as the status of several other signals. This interrogation is achieved by TTL NAND gate 270, TTL inverter 272, 8-bit multiplexer 274, and buffers 275-281.

The state of the $I_O$ input to multiplexer 274 indicates the state of flipflop 264. This input, therefore, indicates whether a SMTRCK pulse has been produced and a step of the stepper motor has been taken.

The $I_1$ input to multiplexer 274 is received from the CUT signal status circuit 282, which includes inverters 284 and 286, OR gate 288, counter 290, flipflop 292, and an indicator circuit formed by buffer 294, resistor R9, and light emitting diode LED1. Prior to receiving the CUT signal, which indicates that a cut mark has been sensed, the $\overline{Q}$ output of flipflop 292 is high and the $I_1$ input to multiplexer 274 is low. When the CUT signal goes high, the output of inverter 284 goes low, thereby removing the reset from counter 290 and causing LED1 to turn on. If the CUT signal remains high for the time required for counter 290 to count until its $Q_3$ output goes high, flipflop 292 will be clocked and the $\overline{Q}$ output will go low. A high input at the $I_1$ input to multiplexer 274, therefore, indicates a cut mark has been sensed. The $I_1$ input remains high until flipflop 292 is reset by the $O_2$ output of latch 258.

The $I_2$ input to multiplexer 274 is received from the END signal status circuit 294. END signal status circuit 294 is essentially identical to cut signal status circuit 282 and contains inverters 296 and 298, OR gate 300, counter 302, flipflop 304, and an indicator circuit including buffer 306, resistor R10, and LED2. The $I_2$ input to multiplexer 274 is low until the END signal goes high, at which time input $I_2$ goes high. It remains high until flipflop 304 is reset by the $O_1$ output of latch 258.

The $I_3$ input to multiplexer 274 is the $\overline{\text{PACKER}}$ signal. This signal indicates whether the automatic paper cutter is being operated in conjunction with a photopacker.

The $I_4$ input to multiplexer 274 is received from KNIFE ENABLE status circuit 306, which includes resistors R11 and R12, capacitor C3, Zener diode ZD1, optoisolator 308, and an indicator circuit formed by buffer 310, LED3, and resistor R13. KNIFE ENABLE status circuit 306 receives the KNIFE ENABLE + and − signals from packer 164. The $I_4$ input to multiplexer 274 is high when the KNIFE ENABLE + and − signals from packer 164 call for enabling of the paper cutter knife assembly.

Microprocessor 170 interrogates multiplexer 274 when the AB11 and $\overline{\text{I/OR}}$ signals are low. This causes multiplexer 274 to be enabled and also causes the outputs of buffers 275-281, which are connected to data bus lines DB0-DB6, to be low. Only DB7, which is the output of the multiplexer 274, supplies data to microprocessor 170. Address lines AB8-AB10 select the particular input of multiplexer 274 which is connected to DB7.

Stepper motor phase generator circuit 188 of FIG. 4 receives the SMTRCK and SMCW signals from stepper motor clock 186 of FIGS. 10A and 10B. Stepper motor phase signals are generated in response to the SMTRCK signal and supplied to stepper motor driver 190 (shown in FIG. 4). Each pulse of the SMTRCK results in one step of stepper motor 40. The SMCW signal determines the direction of the stepper motor steps by controlling the phase relationship of the stepper motor phase signals produced by stepper motor phase generator circuit 188.

A detailed description of one successful embodiment of stepper motor phase generator circuit 188 and stepper motor driver 190 may be found in the previously mentioned co-pending application entitled "Stepper Motor Control". Further detailed discussion of the operation of stepper motor phase generator circuit 188 and stepper motor driver 190 is not necessary for an understanding of the present invention, and will not be undertaken in the present patent application.

Similarly, a detailed description of specific indicia sensor assemblies 52 and 54 and sensor amplifier circuit 160 used in one successful embodiment of the high speed, microprocessor controlled, automatic paper cutter may be found in the previously mentioned co-pending application entitled "Multichannel Indicia Sensor for Automatic Photographic Paper Cutter", and will not be discussed in detail in the present application. For the purposes of the present invention, either the multichannel indicia sensor assembly described in the abovementioned patent application or other sensor assemblies of the type used in the prior art may be used.

Figure 12:
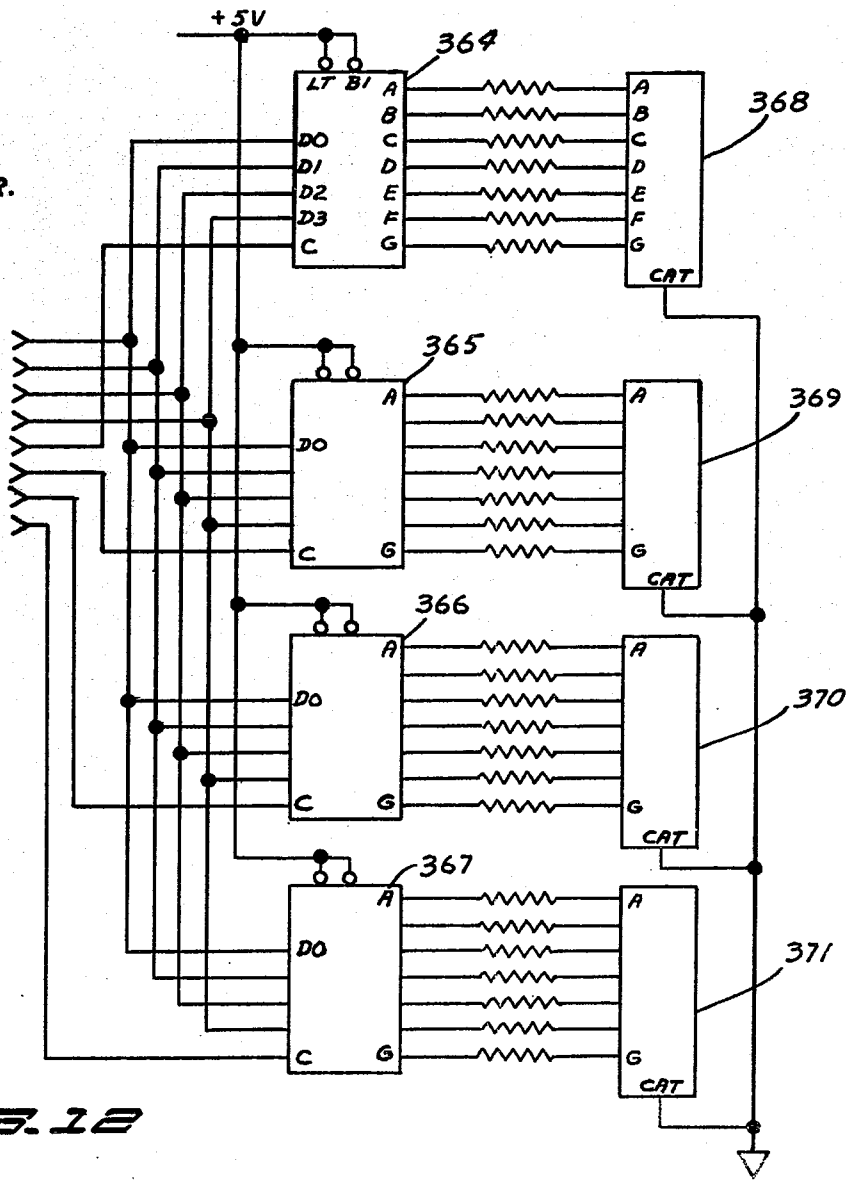
FIG. 12 is an electrical schematic diagram of the display on the main control panel.
Figure 9:
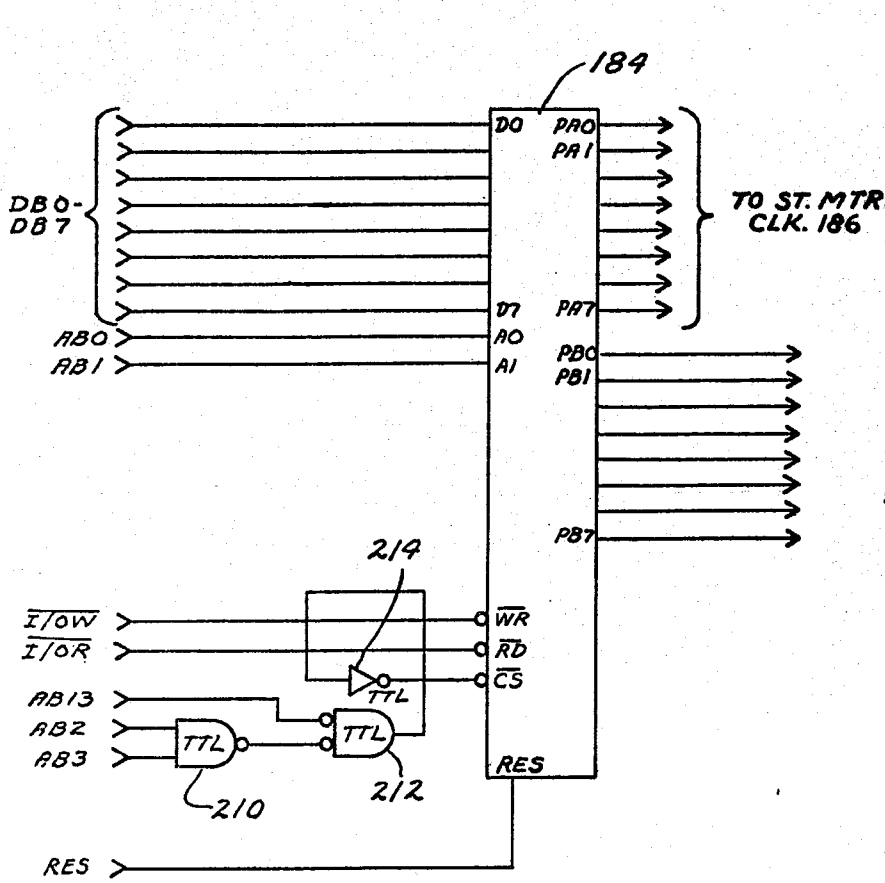
Figure 9:
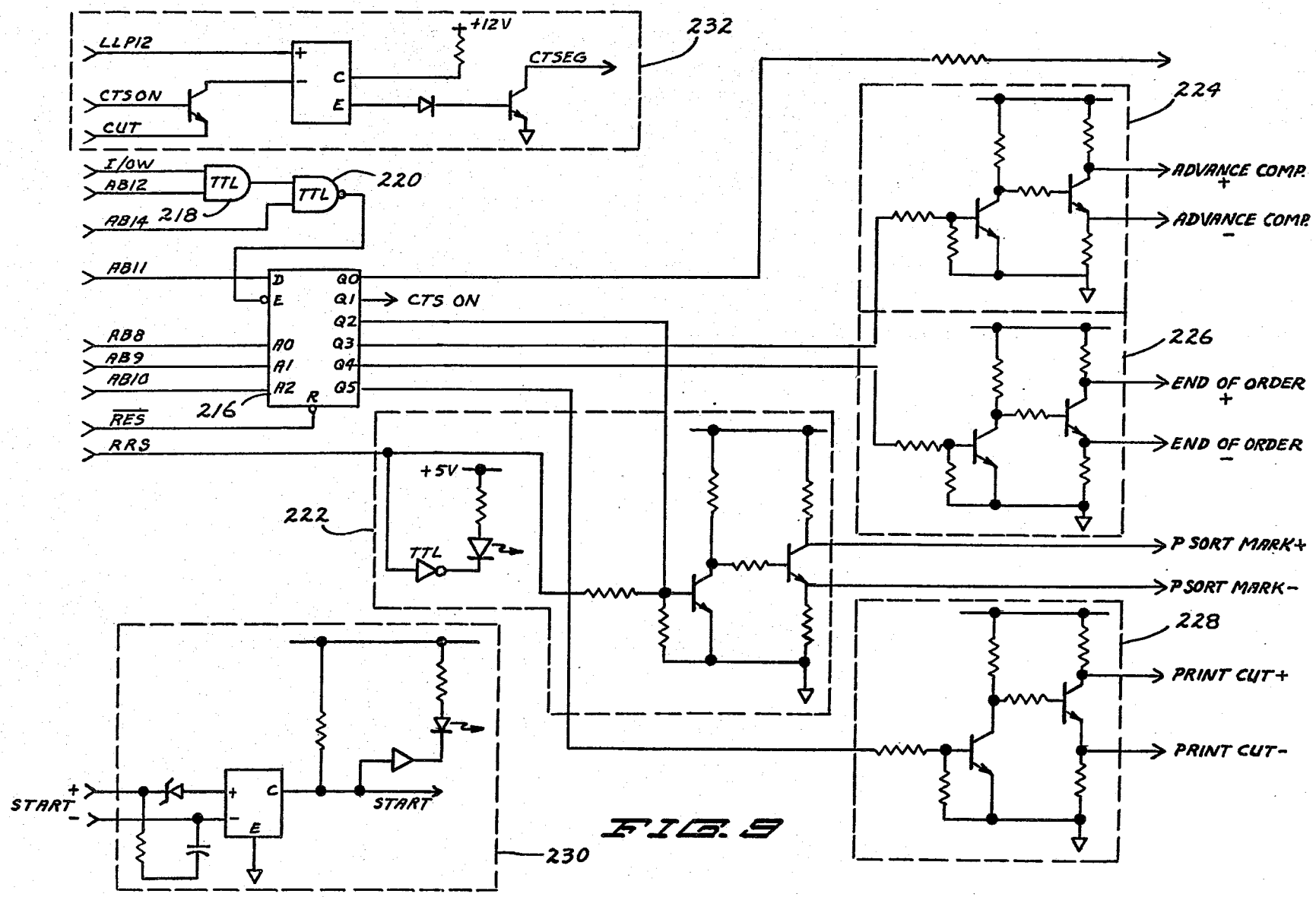
Figure 11A:
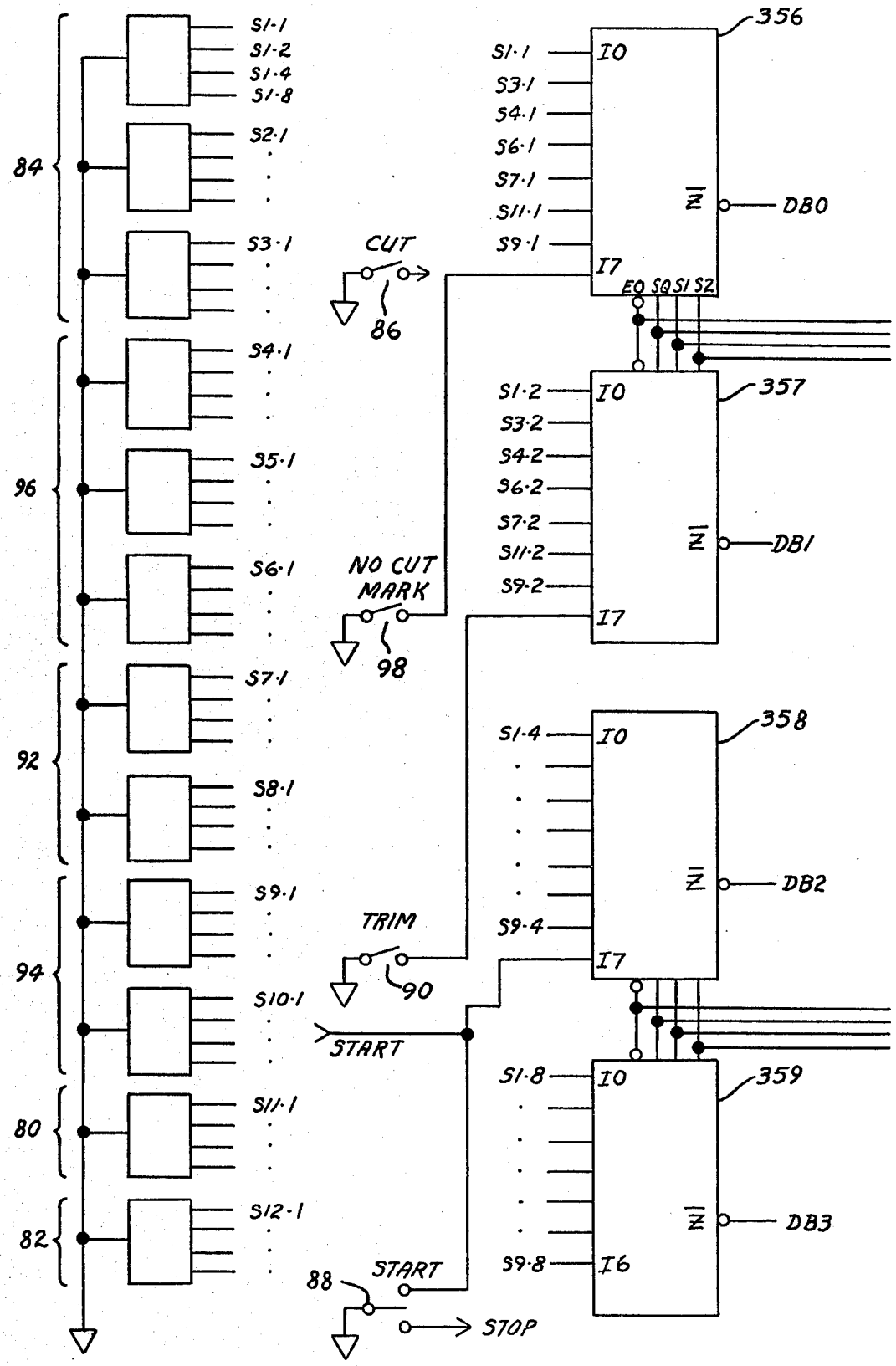
FIGS. 11A and 11B are an electrical schematic diagram of some of the switches of the main and auxiliary control panel, together with associated control panel logic.
Figure 11B:
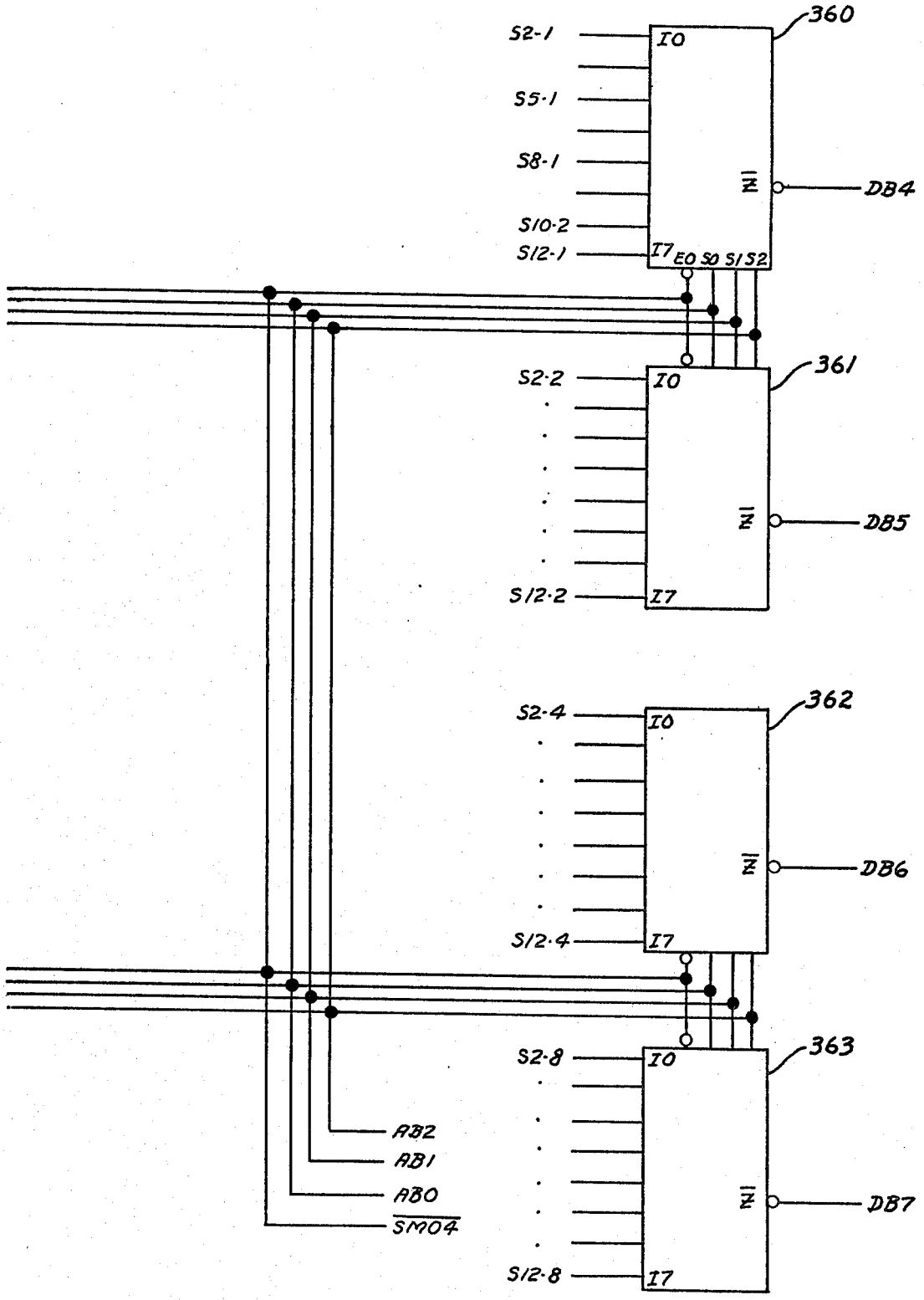

The remaining circuitry of interest is shown in FIGS. 11A, 11B and 12. FIGS. 11A and 11B are a schematic diagram showing switches of main and auxiliary control panels 72 and 74 and control panel logic 156. FIG. 12 is a schematic diagram showing display 76 and its driver circuitry.

As shown in FIGS. 11A and 11B, the control panel logic 156 includes eight multiplexers 356-363, each capable of receiving eight inputs. The outputs of multiplexers 356-363 are connected to data bus lines DB0 through DB7, respectively. The particular signals supplied by the multiplexers to the data bus are selected by the SM04, AB0, and AB2 lines.

The inputs to multiplexers 356-363 are derived from the various switches contained on the main and auxiliary panels 72 and 74. The configuration shown in FIGS. 11A and 11B allows microprocessor 170 to address the various switches as memory locations.

Feed Length switch 84 is a three digit, ten position digital thumbwheel switch which allows the feed length to be selected in 0.012 inch nominal increments from 0 to 999 steps. The outputs of switch 84 are in binary coded decimal (BCD) format.

Feed-After-Cut-Mark switch 96 is a three digit, ten positon digital thumbwheel switch. Because in the present invention the paper cutter has fixed rather than adjustable sensors, the length that the paper advances after a mark is sensed must be varied depending upon the cut mark location on the prints. The length of advance after sensing is selected in 0.012 inch increments from 0 to 999 steps using switch 96.

Length of Cut Out switch 92 is a two digit, ten position digital thumbwheel switch which allows the operator to select the length of cut out in 0.012 inch nominal increments from 0 to 99 steps. This switch is used primarily for straight borderless prints to control the length of slug cut out between prints.

Maximum Number of Prints switch 94 is a two digit, ten position digital thumbwheel switch. The number set into switch 94 (which may vary from 0 to 99) establishes the number of prints that will be cut before the paper cutter stops.

Speed Select switch 80 is a one digit, ten position digital thumbwheel switch. Ten discrete paper cutter cycle speeds can be selected, depending upon the position of switch 80. The speed is varied from 800 to 4200 steps per second in nine increments. Each increment is 20% larger than the previous speed.

When Speed Select switch 80 is at the highest speed position, it also causes paper cutter control 154 to coordinate the operation of the stepper motor 40 and the knife assembly in order to achieve highest possible operating speed. In particular, when the highest speed is selected by Speed Select switch 80, paper cutter control 154 causes the knife assembly to energize slightly before the paper comes to a complete stop. This allows higher speed operation, because there is a slight time delay between the time that the knife assembly receives an energizing signal and the time that the knife actually begins to cut. This coordination of operation allows the highest possible cutter speeds when Speed Select switch 80 has selected the highest speed available.

Mode Select switch 82 is a double width, ten position digital thumbwheel switch that allows the operator to select different operating modes such as RUN, TEST, FEED LENGTH CALIBRATE, and FEED AFTER SENSE. Mode Select switch 82, together with microprocessor 170, allow Start/Stop switch 88 to perform a variety of different functions, depending upon the particular mode selected.

Start/Stop switch 88 is a two position toggle switch which controls the operation of the paper cutter. When Mode Select switch 82 is in the RUN mode, the Start position of Start/Stop switch 88 initiates a paper cutter cycle, and the Stop position stops the paper cutter at the end of the present cycle. When Mode Select switch 82 is in a different mode, Start/Stop switch 88 similarly controls the operation of the cutter in that mode.

As shown in FIG. 11A, a START signal may also be supplied independent of Start/Stop switch 88. The START signal is received from the packer interface circuitry and allows print packer 164 to initiate a paper cutter cycle if the automatic paper cutter is being used in conjunction with print packer 164.

Trim switch 90 is a pushbutton switch. It actuates the knife assembly for one cycle.

Cut Mark/No Cut Mark switch 98 is a two position toggle switch. The operator selects the proper mode which is dependent upon the print paper having or not having cut marks.

Cut/No Cut switch 86 is a two position toggle which controls the operation of the knife assembly.

FIG. 12 shows the circuitry associated with four digit display 76 on main control panel 72. The circuitry includes four seven-segment decoder driver latches 364-367 and four seven-segment LED displays 368-371. Display 368 represents the most significant digit and display; 371 represents the least significant digit. Decoder driver latches 364-367 receive the PB0-PB7 signals from programmable I/O device 184 and drive displays 368-371 in accordance with those input signals.

Automatic Paper Feed Operation in the Event of Missing Cut Marks

The high speed automatic photographic paper cutter described in the preceding section utilizes the alternative automatic paper feed of the present invention in the event of occasional missing cut marks. If a cut mark is missing, the paper is fed the total feed length of the last previous cycle in which cut marks were sensed at both ends of the cycle. Operation of the automatic paper cutter is not halted unless more than a predetermined number of paper feed-and-cut cycles occur without sensing a cut mark.

Prior to automatic operation of the paper cutter, Mode switch 82 is set to the FEED LENGTH CALIBRATE mode and Start switch 88 is actuated. Paper strip 18 is fed from cut mark to cut mark, and the feed length from cut mark to cut mark is displayed on display 76. The value displayed is set into Feed Length switch 84 by the operator.

The operator then sets Mode switch 82 to the FEED AFTER SENSE mode. The edge of a print is aligned with a calibration mark on one of the paper guides (30 or 32). Start switch 88 is then actuated and the paper advances to the next cut mark and stops. The feed-after-sense length is displayed on display 76, and the operator sets that value into Feed After Sense switch 96.

The feed-after-sense length which is displayed on display 76 is derived from the feed length which has been stored in Feed Length switch 84, the distance which paper strip 18 was advanced from the calibration mark until the next cut mark was sensed, and the known distance from the indicia sensor assembly 52 or 54 to the knife assembly. Once the feed-after-sense signal has been derived, displayed, and stored in Feed After Sense switch 96, the automatic paper cutter is ready for regular operation. The operation sets Mode switch 82 to the RUN mode and sets Speed switch 80 to the desired cycle rate. Normal operation is then commenced by actuating Start switch 88.

During a normal paper feed-and-cut cycle in which a cut mark is sensed, paper strip 18 is advanced until a cut mark is sensed by sensor assembly 52 or 54, at which time a CUT signal is generated. Once the CUT signal has been produced, paper strip 18 is advanced by an additional distance determined by the feed-after-sense signal stored in feed-after-sense switch 96. In preferred embodiments, paper cutter control 154 causes stepper motor 40 to decelerate as the end of the print is approached. The deceleration (i.e. a down ramp in stepper motor frequency) usually begins some time after the CUT signal has been received, and a predetermined number of steps before stepper motor 40 is stopped. This predetermined number of steps depends upon the stepper motor speed selected by the Speed switch 80.

The present invention controls the paper feed during a paper feed-and-cut cycle in which no cut mark is sensed. The cut mark may be missing because of a malfunction of the printer which produces the cut marks, an irregularity in the paper, or some other cause. In the prior art systems, a missing cut mark would result in an erroneous feed or in the stopping of the automatic paper cutter, or both.

With the present invention, an occasional missing cut mark will not result in an erroneous feed or in the stopping of the automatic paper cutter. At the beginning of each paper feed-and-cut cycle, the paper is fed by a first number of steps which is derived by subtracting the feed-after-sense number of steps and one half of a "window" from the feed length stored by feed length switch 84. During the advancement of the paper strip 18 by the first number of steps, no CUT signal will be accepted since it is occurring too early in the paper feed-and-cut cycle to be valid.

When the first number of steps is completed, the paper feed is then permitted to advance the paper by the number of steps of the window. During a normal paper feed-and-cut cycle, a cut mark will be sensed within this window, and the paper strip 18 will then be advanced by an additional distance corresponding to the feed-after-sense length. If, however, the entire distance represented by the window has been advanced and no CUT signal has been produced, the cut mark is assumed to be missing and the length which the paper is advanced must be determined on a different basis.

At the completion of each paper feed-and-cut cycle, the paper cutter control 154 determines whether cut marks were sensed at the end of that cycle and at the end of the immediately preceding cycle. In other words, it determines whether cut marks were sensed "at both ends" of the cycle. If cut marks have been sensed at both ends of the cycle, paper cutter control 154 stores the total feed length of paper strip 18 during that cycle. As each cycle is completed, paper cutter control 154 updates the stored total feed length, so that at any time it has stored the total feed length of the last paper feed-and-cut cycle in which cut marks have been sensed at both ends.

When a cycle occurs in which a cut mark is not sensed during the window, the paper cutter control 154 causes paper strip 18 to be advanced by the total feed length stored for the last preceding paper feed-and-cut cycle in which cut marks were stored at both ends.

Paper cutter control 154 also counts the number of consecutive cycles in which a cut mark was not sensed within the window. When this count exceeds a predetermined number of cycles (in a preferred embodiment, two cycles) the paper feed-and-cut cycles are terminated since statistically the occurrence of more than two consecutive paper feed-and-cut cycles with missing cut marks indicates that a more serious problem exists and should be checked by the operator before further operation of the automatic paper cutter continues.

In the preferred embodiment of the present invention described in previous sections, microprocessor 170 controls the various operations of the automatic photographic paper cutter, including control of the paper feed under both normal and missing cut mark conditions. The operation of microprocessor 170 relating to the present invention is illustrated by the flow charts shown in FIGS. 13-22F. In addition, assembler listings for the entire operation of microprocessor 170 are shown in Table 1, of the previous mentioned copending application by Strunc and Laciak, now U.S. Pat. No. 4,128,887.

It should be noted that the flow charts shown in FIGS. 13-22F of this patent application represent only those portions of the operation of microprocessor 170 which are directly related to the present invention. It is clear from the preceding discussion, and from the assembler listings shown in Table 1, that microprocessor 170 controls other functions of the automatic photographic paper cutter in addition to the paper feed control function. For a more complete description of the operation of microprocessor 170 in the automatic photographic paper cutter, reference should be made to the previously mentioned co-pending application entitled "Microprocessor Controlled Photographic Paper Cutter".

Figure 13:
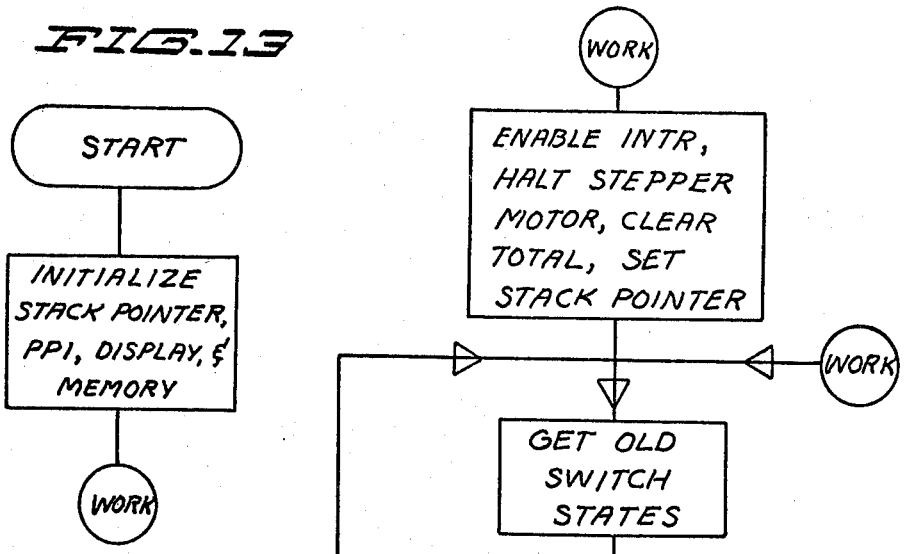
FIGS. 13–22F are flow charts illustrating the operation of the present invention.

FIG. 13 illustrates the INIT routine. This routine is for initial startup and for interrupts. The initial conditions of the system are provided by this routine.

Figure 14A:
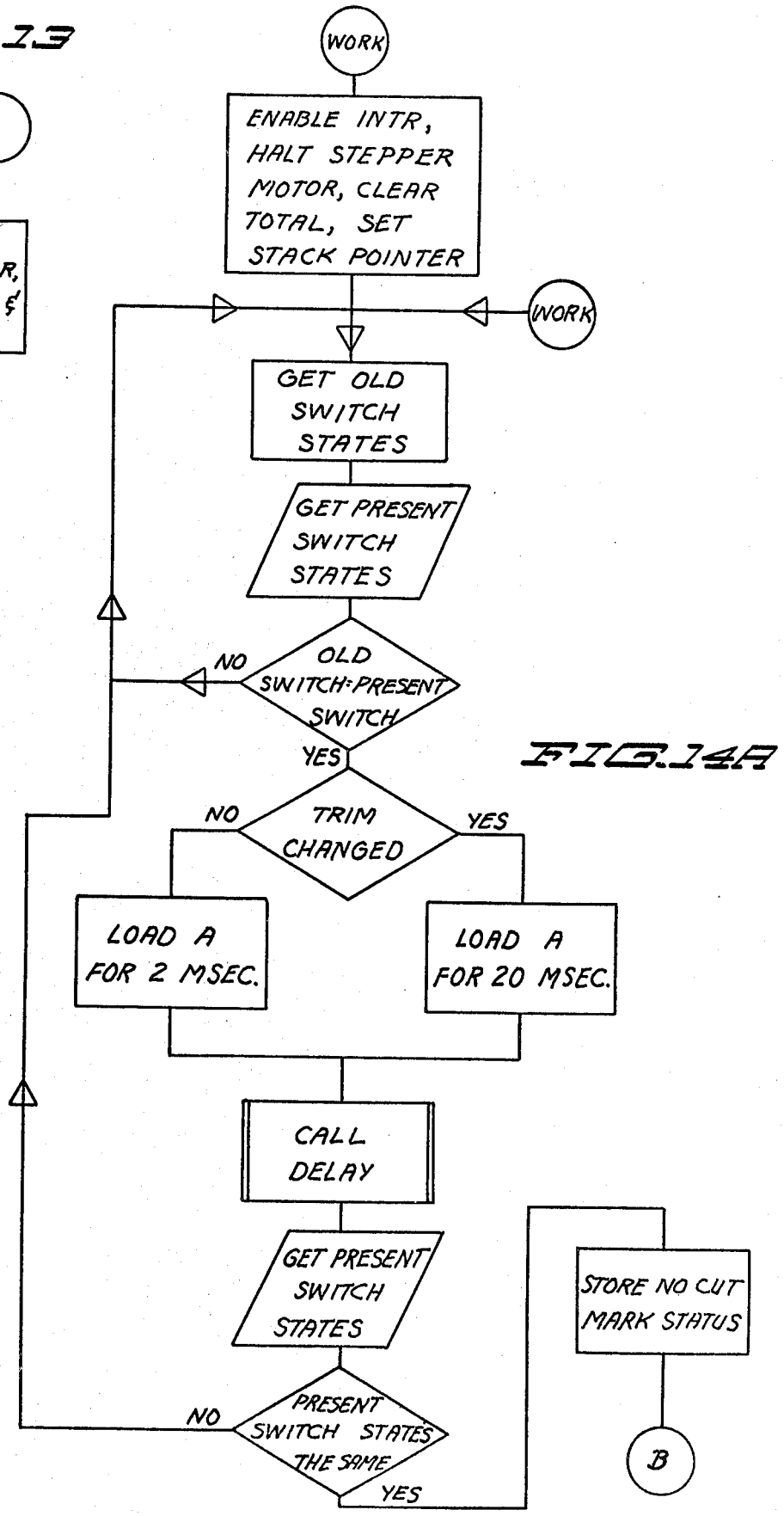
Figure 14B:
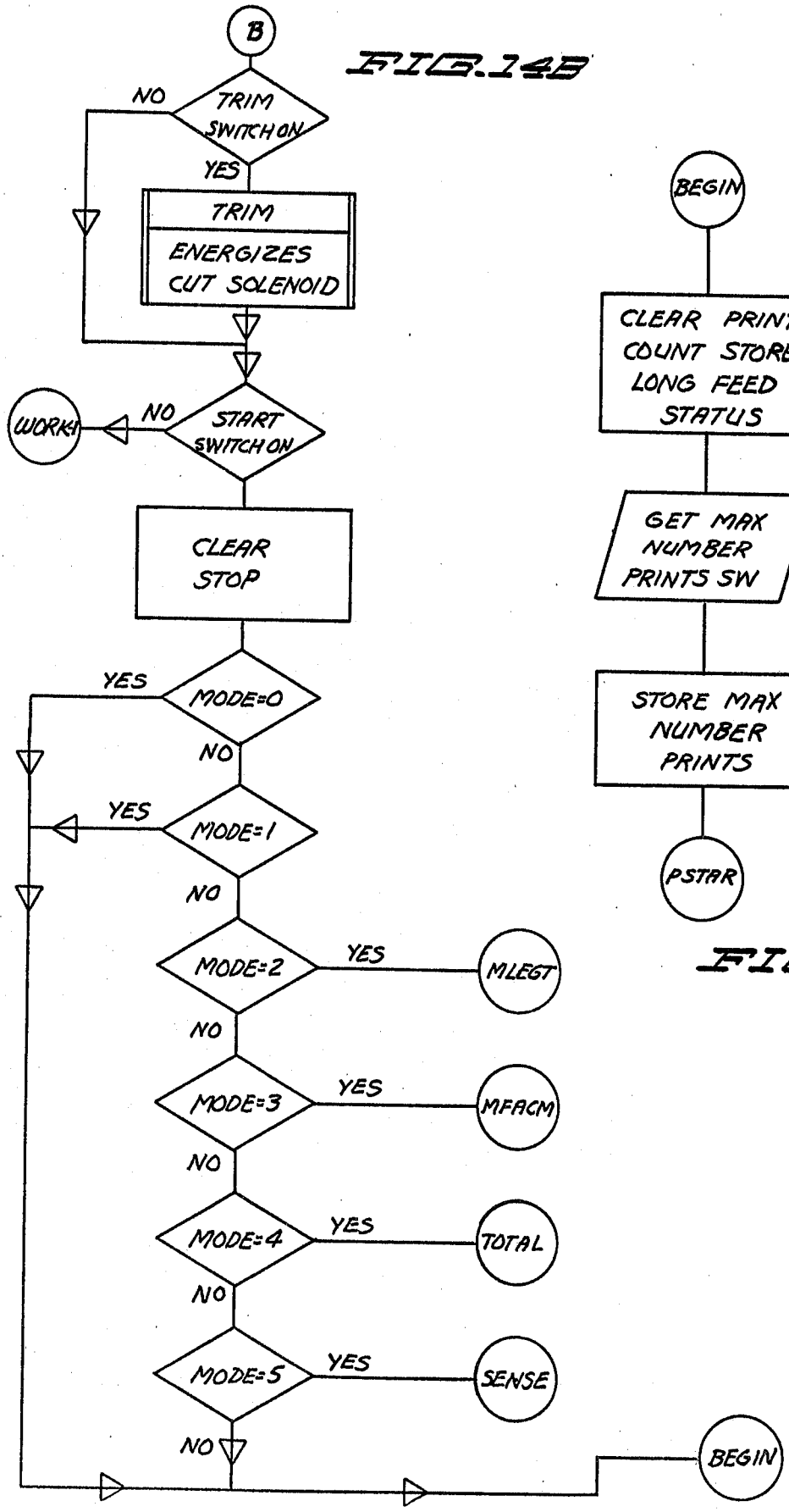

The next routine of microprocessor 170 is WORK. This routine reads the states of the various switches on main and auxiliary panels 72 and 74, and stores this information in appropriate locations of random access memory 180. FIGS. 14A and 14B are flow charts showing the WORK routine.

During the initial set up of the automatic paper cutter, the operator sets Mode switch 82 first to the FEED LENGTH CALIBRATE mode (mode 2) and then to the FEED AFTER SENSE mode (mode 3). As the WORK routine scans the states of the various switches, it checks the modes selected by Mode switch 82. When mode 2 is selected and Start switch 88 is actuated, the SETUP routine shown in FIGS. 15A-15C is commenced.

Figure 15A:
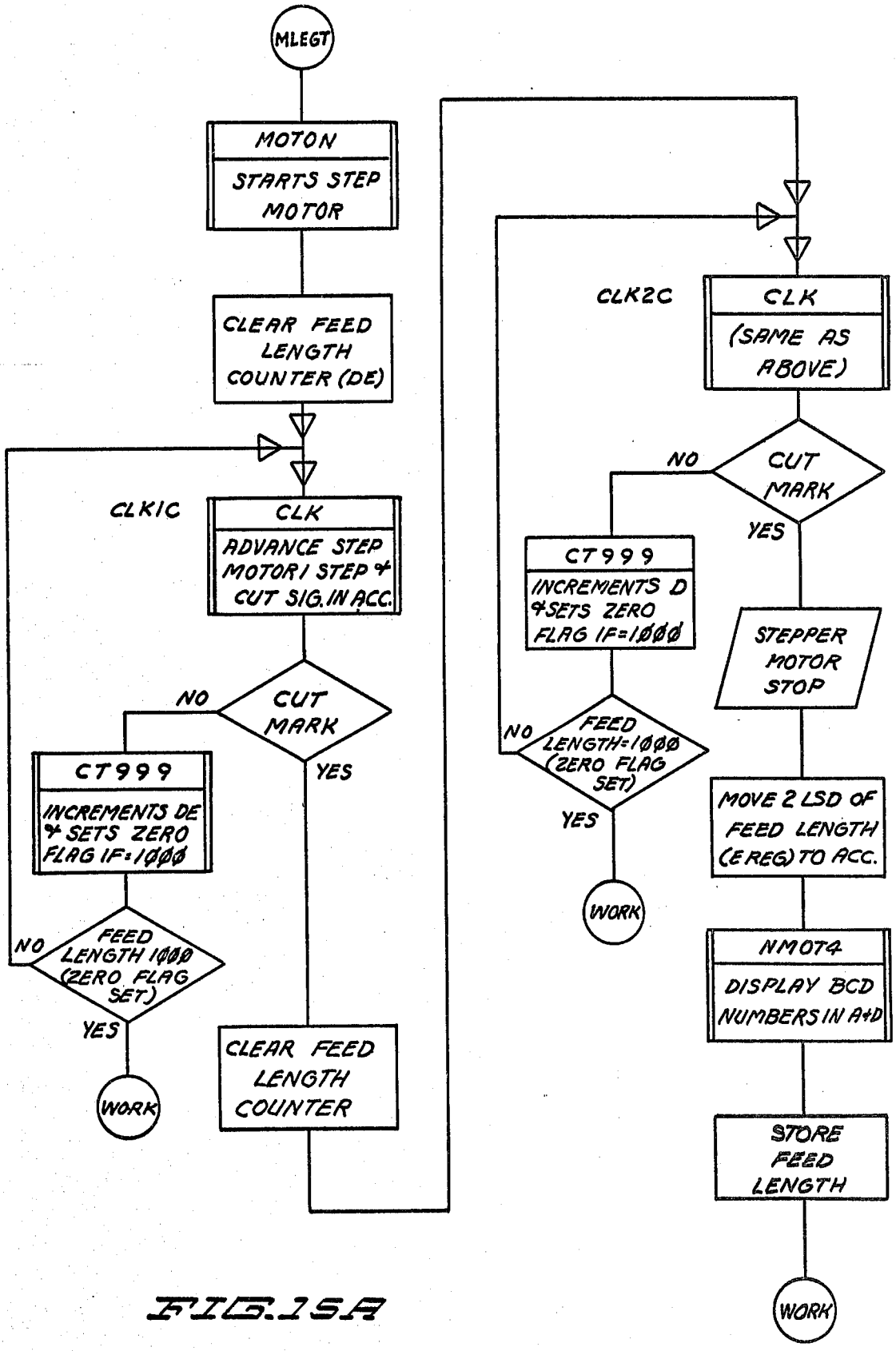
Figure 15B:
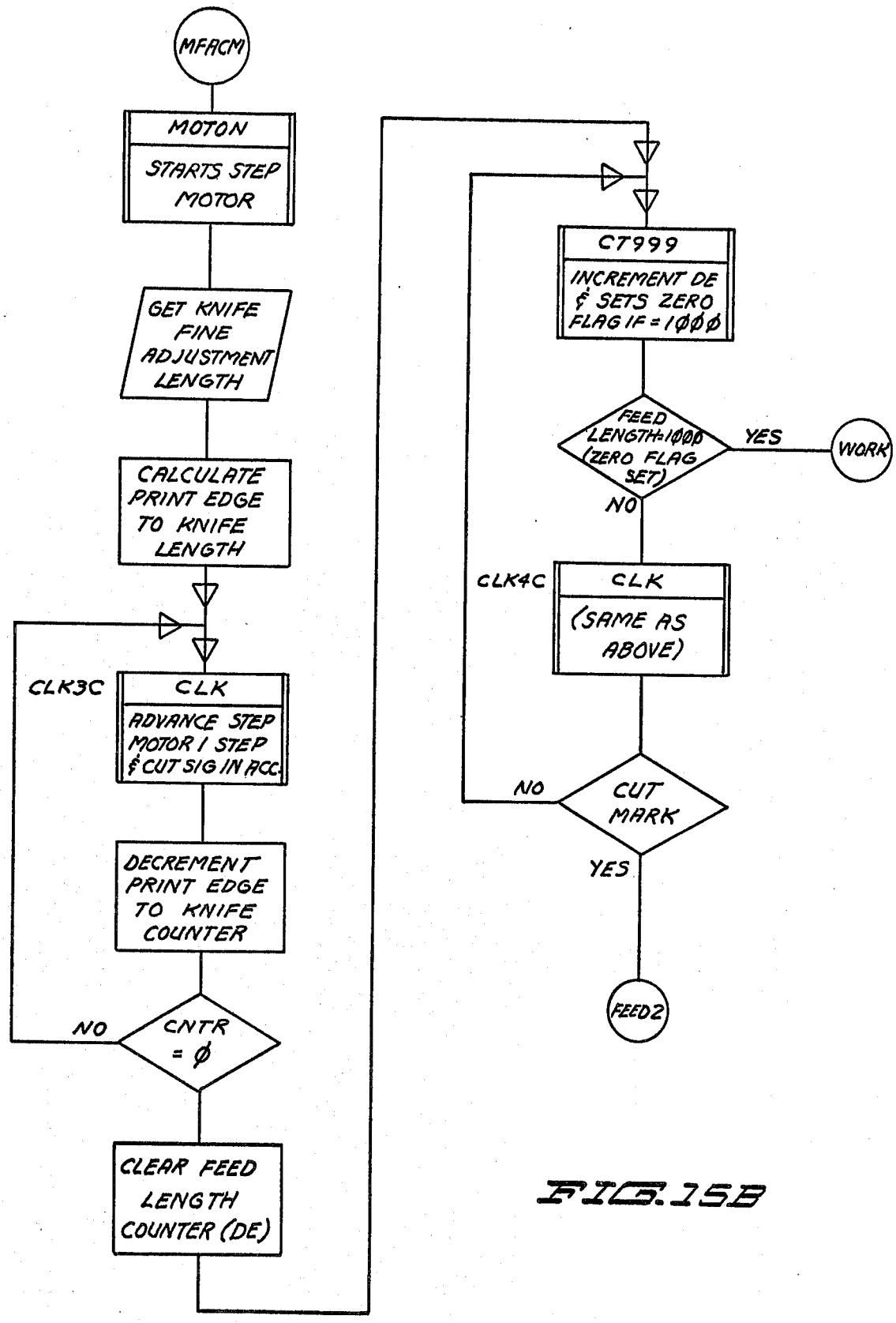
Figure 15C:
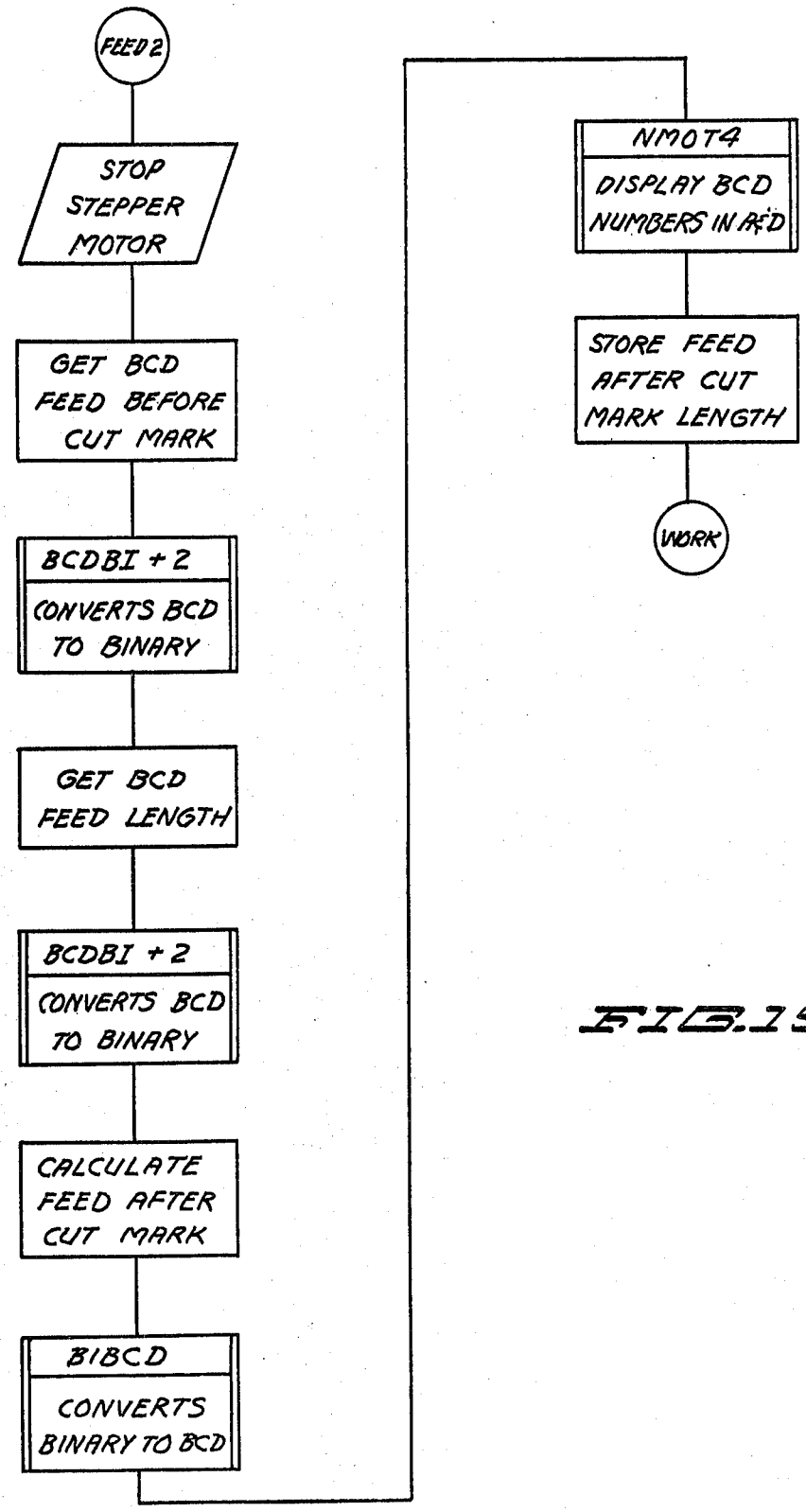

The MLEGT function shown in FIG. 15A measures the length of a print from cut mark to cut mark. Stepper motor 40 is turned on by the MOTON call and the feed length counter is cleared. Paper strip 18 is vanced, a step at a time, until a cut mark is sensed. At that time, the feed length counter is again cleared and the stepper motor is advanced a step at a time until the next cut mark is sensed. As the paper strip 18 is advanced, the count in the feed length counter is incremented until the cut mark is sensed. At that point, the stepper motor is stopped and the feed length from cut mark to cut mark is displayed by display 76. The operator stores the feed length which has been displayed by adjusting Feed Length switch 84 and sets Mode switch 82 to the FEED AFTER SENSE mode (mode 3).

As shown in FIG. 15A, after the feed length has been stored, microprocessor 170 returns to the WORK routine and scans the states of the various switches. Since mode 3 has now been selected, actuation of Start switch 88 will cause the MFACM function of the SETUP routine to be performed. This function is shown in FIGS. 15B and 15C.

When the FEED AFTER SENSE mode (mode 3) has been selected, the operator sets the edge of a print to a calibration mark on one of the paper guides (30 or 32). When Start switch 88 is actuated, the MFACM function causes paper strip 18 to be advanced until a cut mark is sensed.

While the paper strip 18 is being advanced, each step of stepper motor 40 is sensed and counted. This counting is first used to decrement the print edge-to-knife counter until it reaches zero. The number initially in the print edge-to-knife counter represents the number of steps between the indicia sensor and the knife assembly.

Once the print edge-to-knife counter reaches zero, the feed length counter is cleared and the number of steps taken by stepper motor 40 is counter until a cut mark is sensed. When the cut mark is sensed, the stepper motor is stopped and the feed-after-sense or feed-after-cut mark length is calculated and displayed. The feed-after-sense length equals the feed length stored in Feed Length switch 84 minus the length in the feed length counter. The operator then sets the displayed number into Feed-After-Cut Mark switch 96, and the SETUP routine is completed.

Figure 16B:
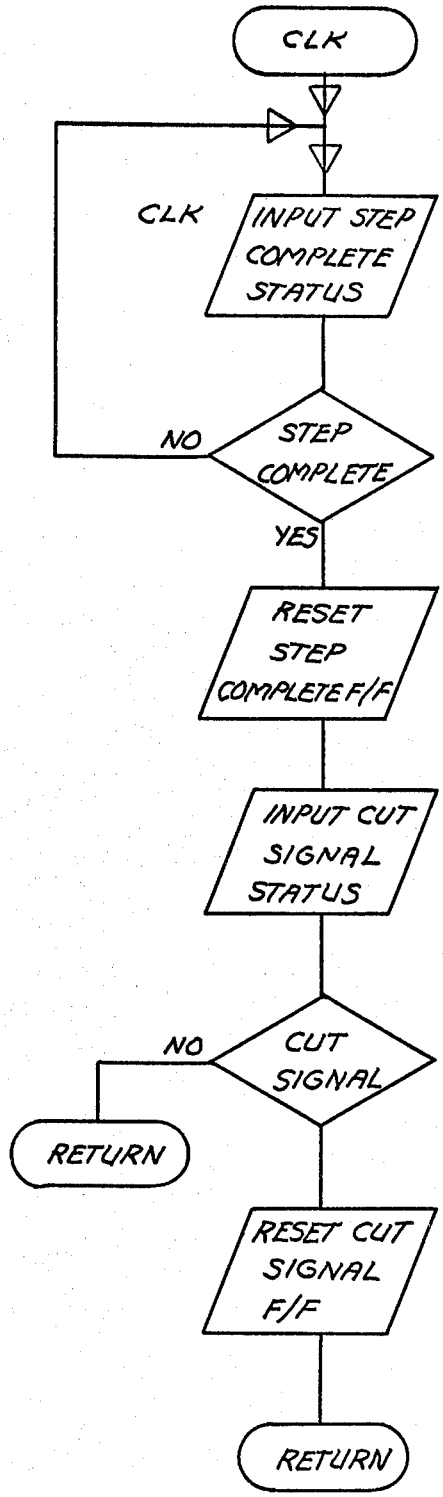
Figure 16C:
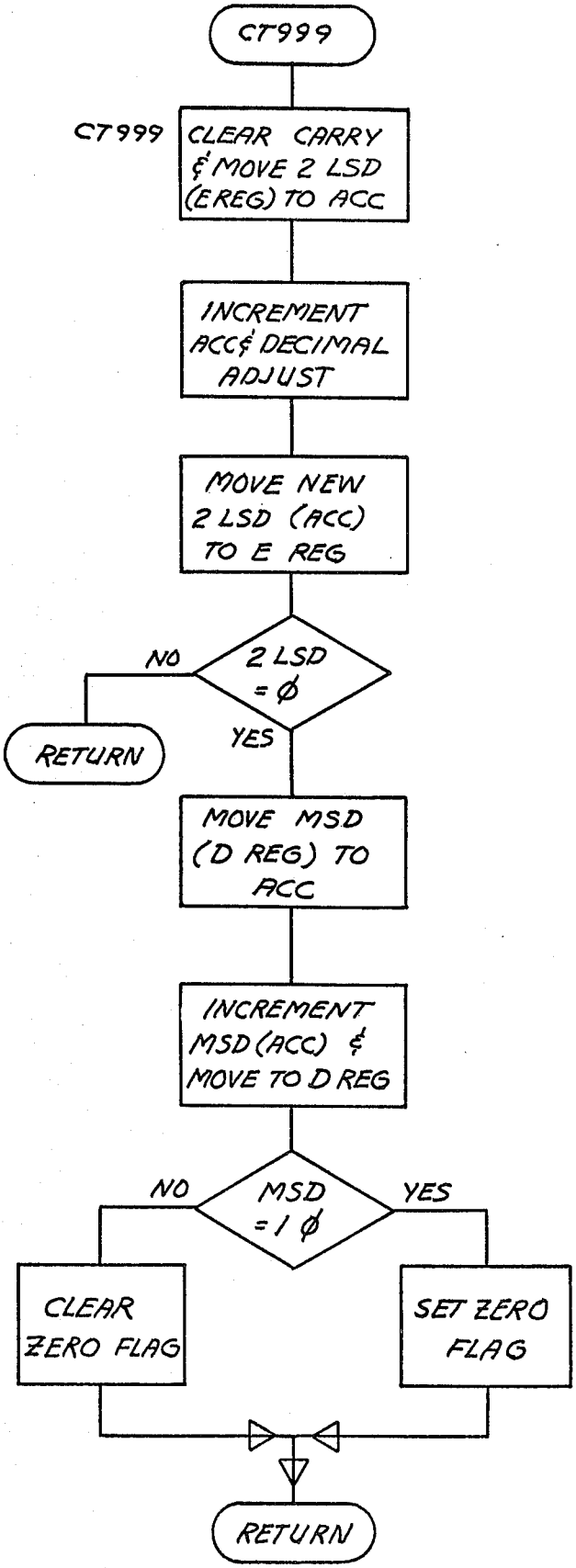

FIGS. 16A-16C show three calls which are used in the SETUP routine. The three calls are MOTON, CLK, and CT999.

Figure 17:
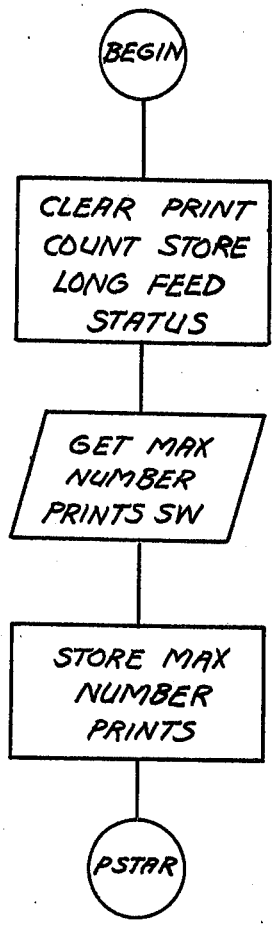

After the SETUP routine has been completed, the operator sets Mode switch 82 to the RUN mode, and the automatic photographic paper cutter is ready for automatic operation. When Start switch 88 is actuated, the BEGIN routine is commenced. This routine is performed when the cutter is beginning an order. FIG. 17 shows the BEGIN routine.

Figure 18A:
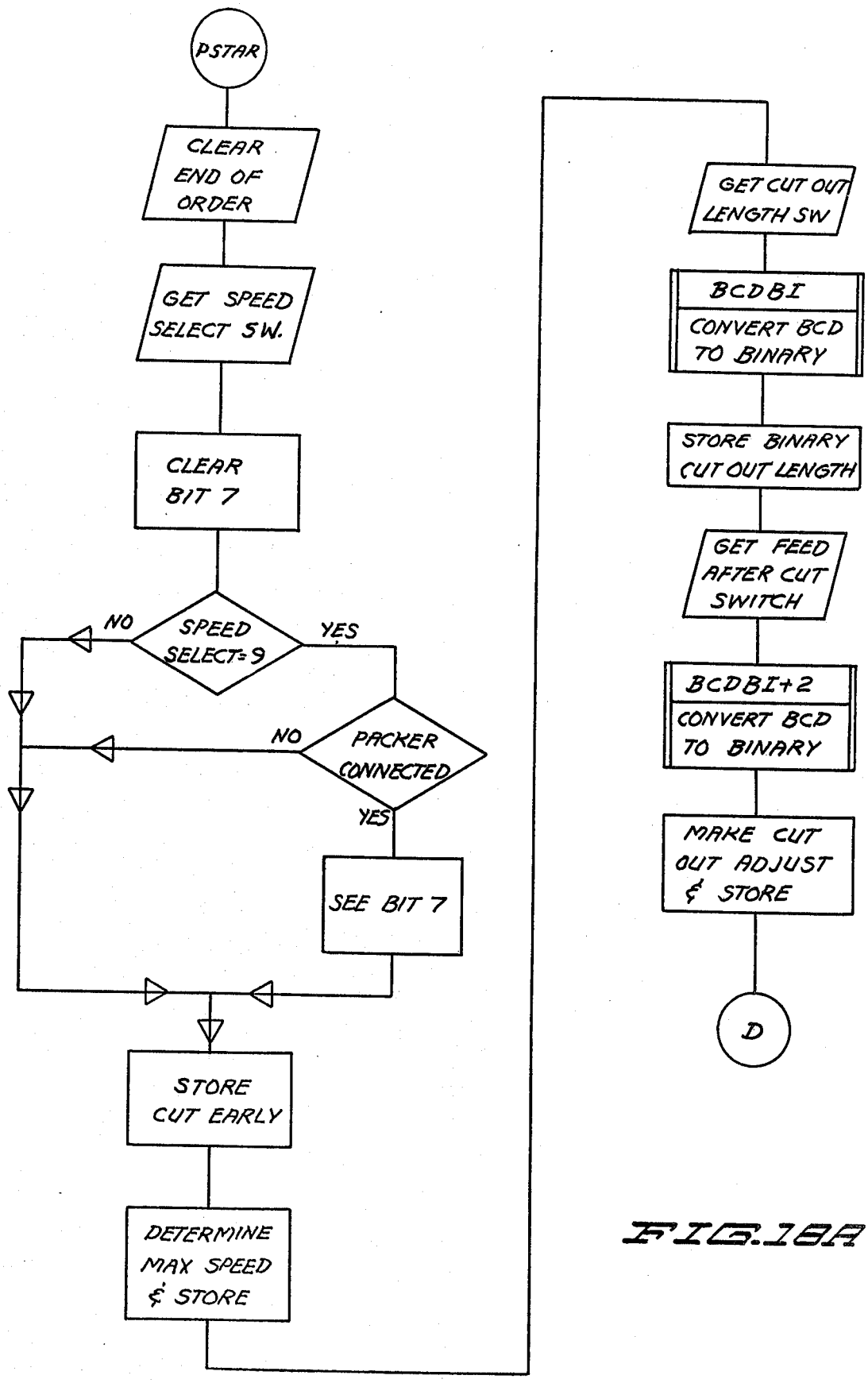

The next routine is the PSTAR routine illustrated in FIGS. 18A and 18B. PSTAR routine is a print/start routine and either follows the BEGIN routine if the cutter is beginning to cut prints from a new customer order, or is commenced at the end of a feed-and-cut cycle when prints from the same customer order have already been cut.

During the PSTAR routine the state of Speed switch 80 is interrogated and the maximum speed is determined and stored. As shown in FIG. 18A, if the highest speed is selected, the PSTAR routine stores an indication that the knife assembly should be energized early so that there is minimal delay time between the stopping of the print paper and the cutting of the paper by the knife.

The PSTAR routine also includes operations which are necessary to determine the proper feed length depending upon whether the cut marks will or will not be sensed. This involves a conversion of the BCD stored information contained in the feed length switch 84, cut out length switch 92, and feed-after-cut mark switch 96.

Figure 19B:
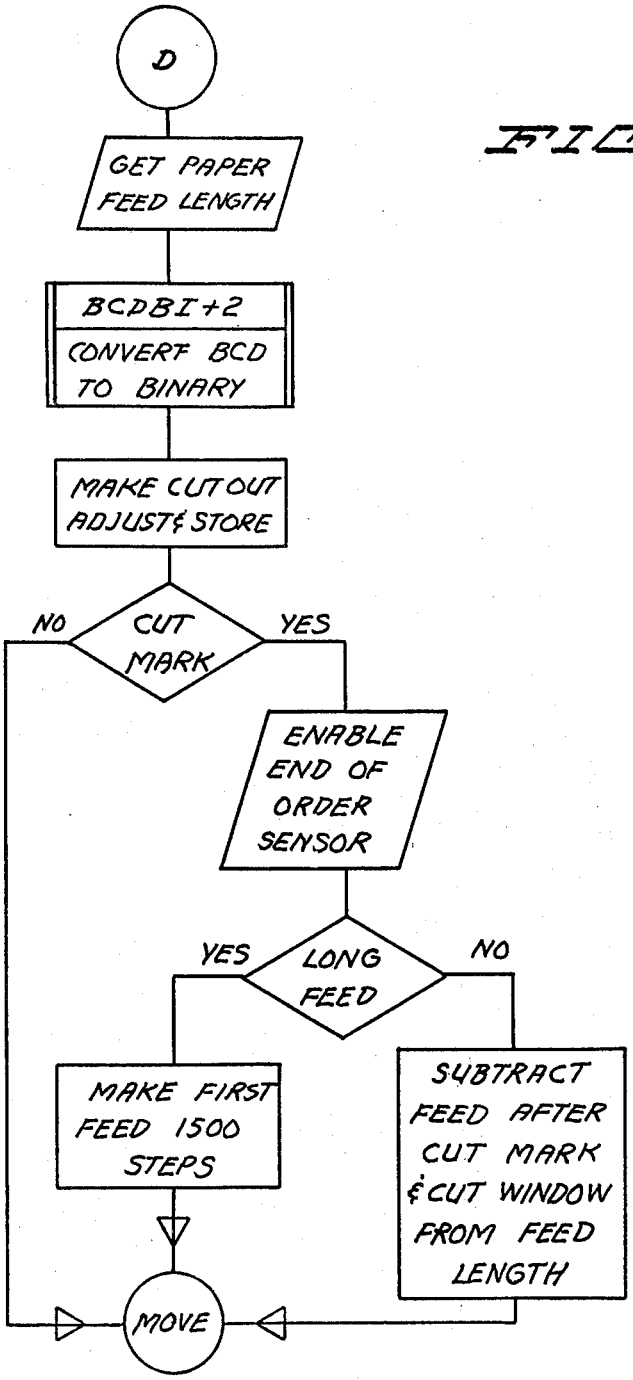
Figure 19A:
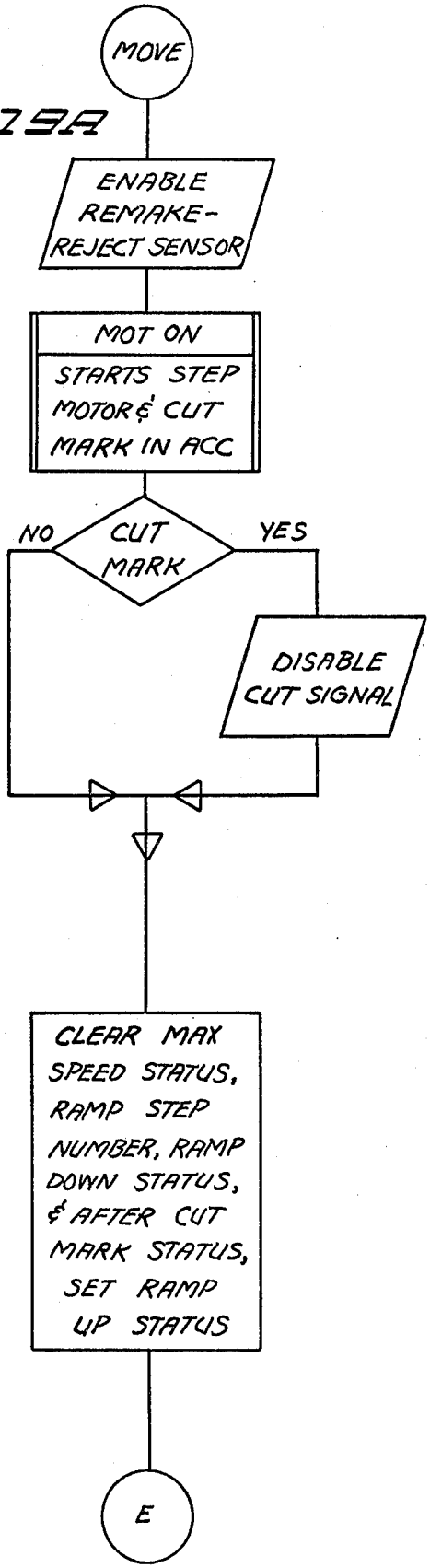
Figure 19B:
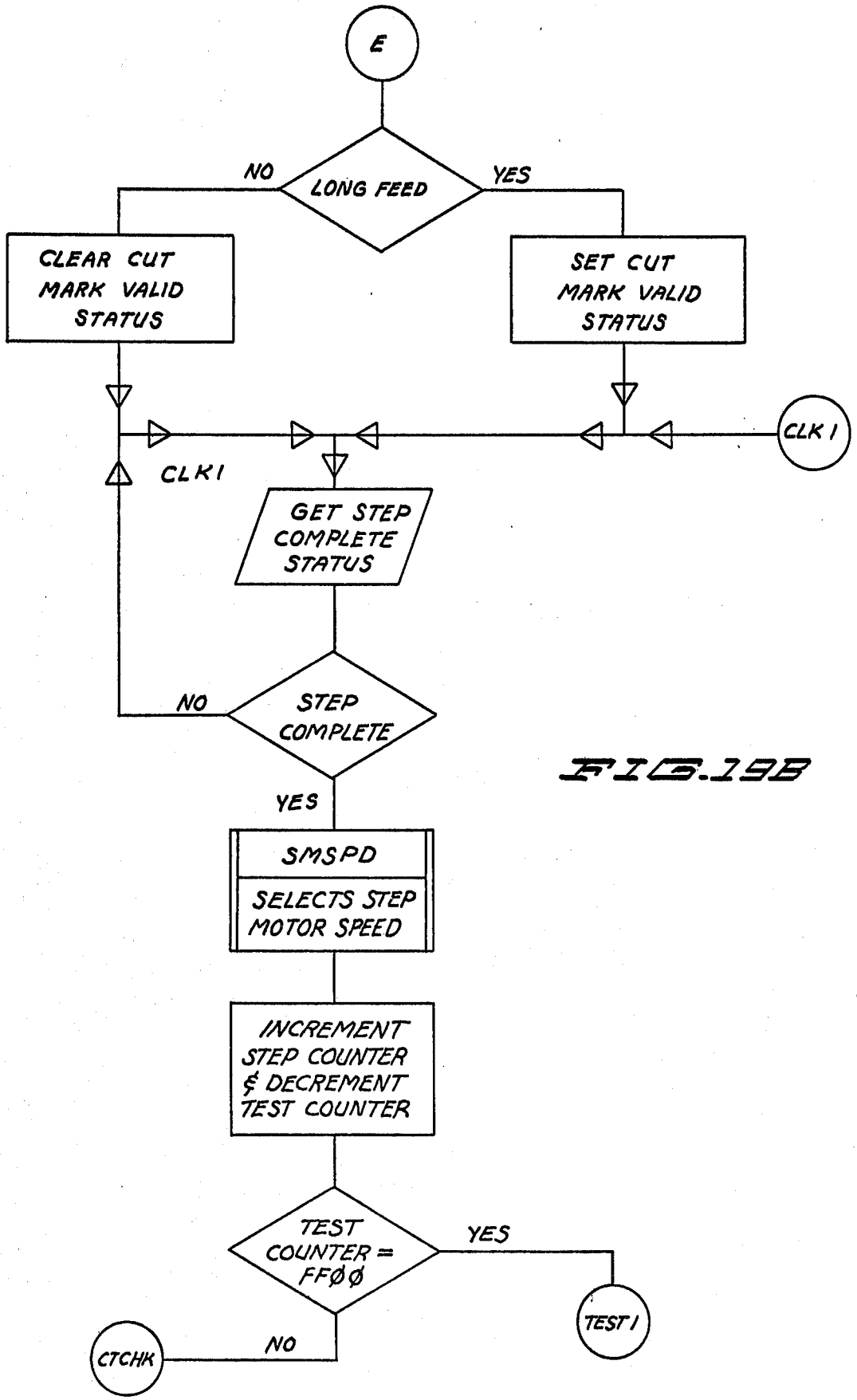

The next routines are the MOVE and the TEST routines, which actually determine the movement of stepper motor 40. FIGS. 19A and 19B illustrate the MOVE routine, and FIGS. 20A-20D illustrate the TEST routine. In the following discussion of the MOVE and TEST routines, both normal automatic operation of the paper cutter and operation in the event of a missing cut mark will be discussed. Normal automatic operation of the paper cutter is the subject of the previously mentioned co-pending application entitled "Paper Feed Control for Photographic Paper Cutter", but is discussed in the present application in order to provide a comparison between normal automatic operation and the operation of the present invention in the case of an occasional missing cut mark.

In both normal automatic operation and operation with an occasional missing cut mark, a test counter is loaded at different times in a paper feed-and-cut cycle with four numbers: (1) the number of steps before a CUT signal is valid or acceptable; (2) the number of steps in a "window" during which a CUT signal is valid; (3) the number of steps before beginning the down ramp; and (4) the number of steps in the down ramp until the end of the print. The particular number (3) differs depending upon whether normal or missing cut mark operation occurs.

The MOVE routine monitors the number of steps that have been taken by incrementing a step counter and decrementing the test counter as each step is taken. With each step, the TEST routine is also performed. When the test counter has a non-zero count, the CTCHK subroutine checks whether a CUT signal has been received, and if not, the microprocessor returns to the MOVE routine and allows another step to be taken. Each time the test counter reaches zero, the TEST routine determines the next number to be loaded into the test counter. If the ramp down is complete, the TEST routine causes the ENDPR routine to be commenced.

Figures 20A, 20B:
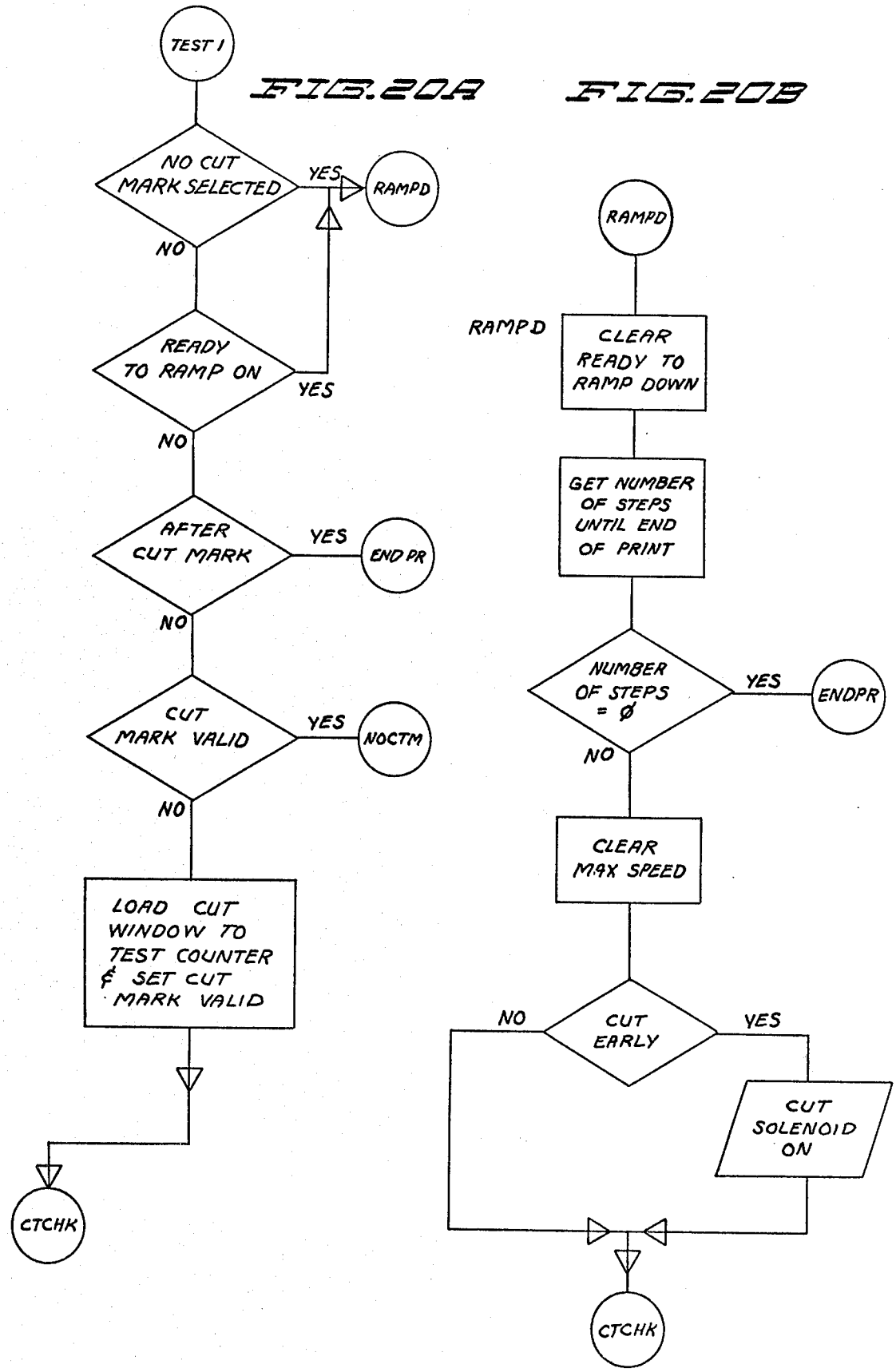
Figures 20C, 20D, 21A:
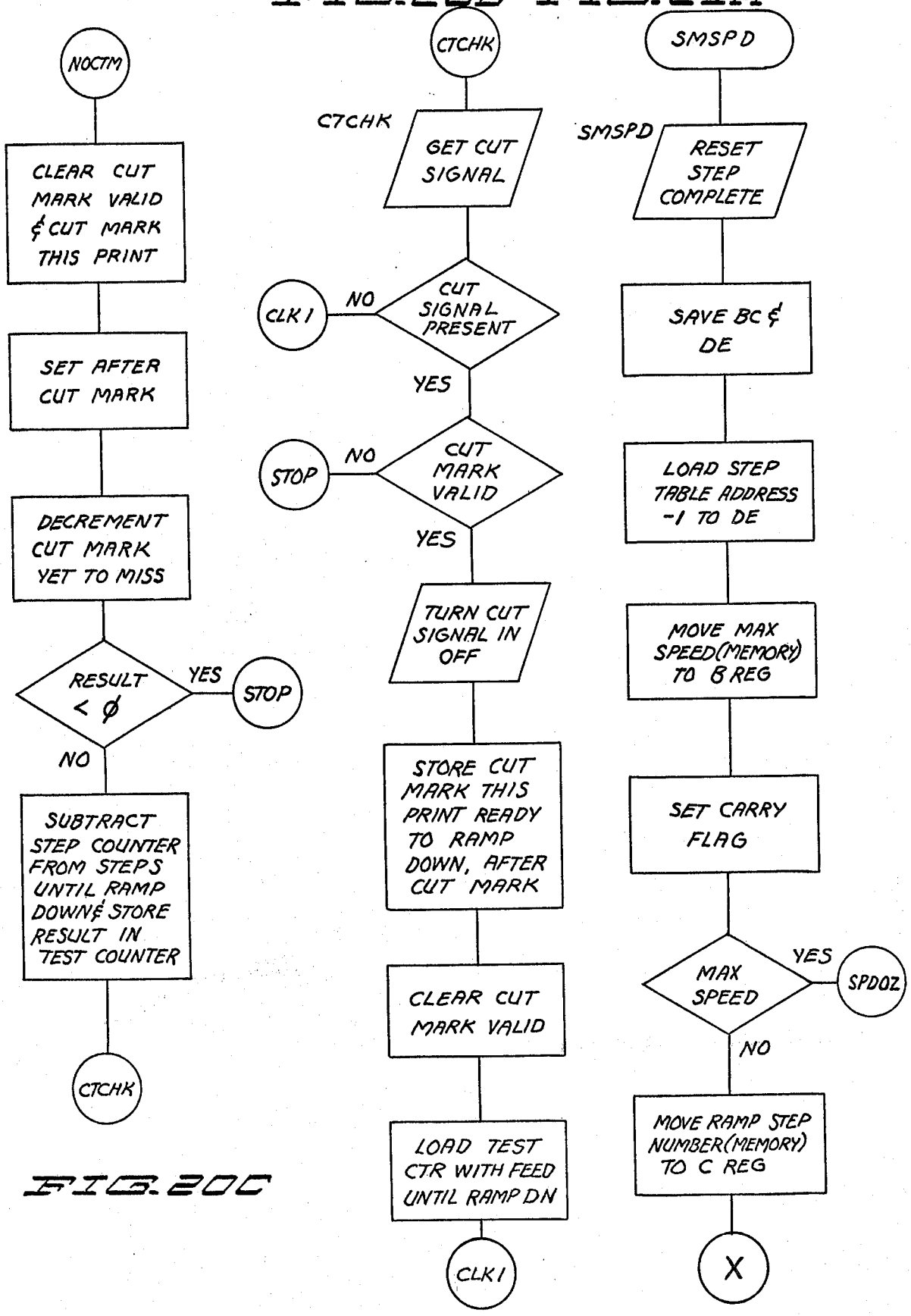
Figure 21B:
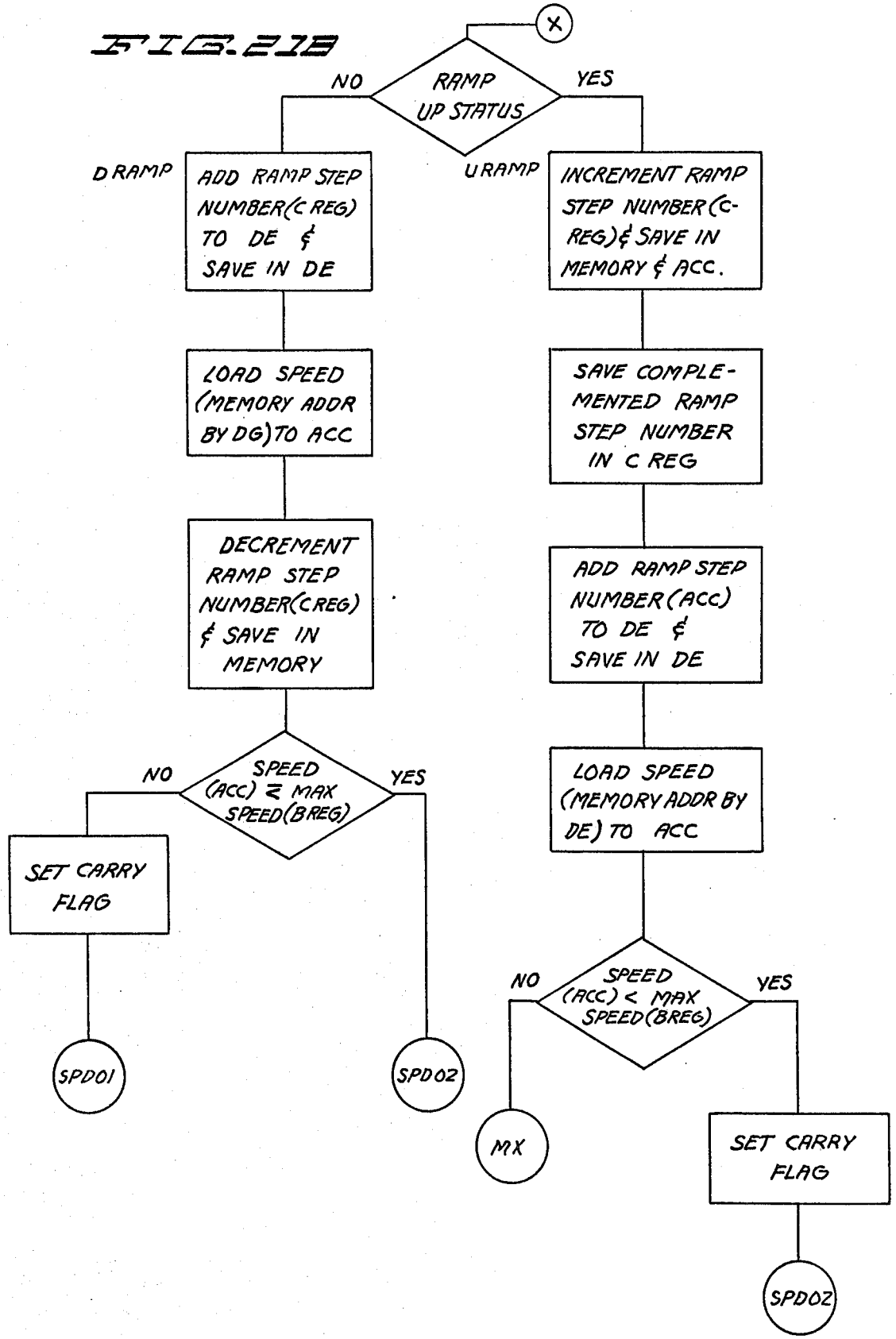

When the paper cutter is operating automatically, stepper motor 40 is started by the MOTON call (shown in FIG. 16A), and operates at speeds determined by the SMSPD routine (shown in the FIGS. 21A-21C and described in greater detail in the previously mentioned co-pending application entitled "Stepper Motor Control" by G. Strunc. The test counter first contains the number of steps to be moved before a cut mark is valid. This first number is generated by the MINFD routine, which forms a part of the PSTAR routine shown in FIGS. 18A and 18B. The MINFD routine subtracts the feed-after-sense length (stored in Feed-After-Cut Mark switch 96) and one half of the "window" within which a cut mark should be present (stored in RAM 180) from the feed length (stored by Feed Length switch 84).

When the test counter is decremented to zero for the first time, it means that the minimum feed before a cut mark is valid has been completed. Since no cut mark has been sensed up to that point, the test counter is loaded with a second number which represents the "window" during which a cut signal should be received. In addition, the cut-mark-valid flipflop is set. Microprocessor 170 then proceeds to the CTCHK subroutine, which determines whether a CUT signal is present. If the CUT signal is not present, the CTCHK routine causes microprocessor 170 to return to the MOVE routive and permit stepper motor 40 to take another step.

Up to this point, both the "normal" and the "missing cut mark" operations are identical. If a cut mark is sensed and a CUT signal is produced within the window (i.e. before the test counter is decremented from the second number to zero), normal operation proceeds. If, on the other hand, no CUT signal is produced during the window, missing cut mark operation is commenced. The following discussion will first describe normal operation briefly, and then will describe missing cut mark operation.

In normal automatic operation, a CUT signal is produced within the window, and the CTCHK subroutine sets flipflops indicating that a cut mark has been sensed this print, that the system is ready to ramp down, and that the cycle is proceding after a cut mark has been sensed. The CTCHK subroutine then loads the test counter with a third number, which is the number of steps to be taken until the down ramp is commenced. This third number was derived during the SMSED routine (FIG. 21C) by subtracting the number of steps required for ramp down from the feed-after-sense number. The MOVE routine is repeated, and with each step the test counter is decremented.

When the test counter again reaches zero, the TEST routine is performed and, because ready-to-ramp-down flipflop is set, the RAMPD subroutine shown in FIG. 20B is performed. In the RAMPD subroutine, the ready-to-ramp-down flipflop is cleared and a fourth number (i.e. the number of steps of the down ramp until the end of the print) is retrieved. If this number is zero, the ENDPR routine is commenced. If, on the other hand, the number of steps is greater than zero so that a down ramp in stepper motor frequency is to occur, the fourth number is loaded into the test counter and the CTCHK subroutine is again performed. Since the cut signal flipflop has been reset by the CTCHK subroutine after it has been received, the MOVE routine is again performed.

When the test counter again reaches zero, the ENDPR routine shown in FIGS. 22A-22E is performed. This routine performs the necessary functions required to complete a paper feed-and-cut cycle. These functions include enabling the knife assembly, determining whether the print which has been cut is the end of a customer order, and whether the maximum number of prints have been cut. If the end of an order has not been reached, and the maximum number of prints has not been cut, the ENDPR routine causes another paper feed-and-cut cycle to be commenced with the PSTAR routine shown in FIGS. 18A and 18B.

In "missing cut mark" operation, no CUT signal is produced within the window. When the test counter has reached zero for the second time, the NOCTM subroutine shown in FIG. 20C is commenced.

The NOCTM subroutine clears the cut-mark-valid flipflop and the flipflop which indicates that a cut mark has been selected for this print. In addition the NOCTM subroutine sets the after-cut-mark flipflop and decrements a counter which contains the number of cut marks which have been missing. If the results of the decrementing are less than zero, the paper cutter is stopped. In a preferred embodiment, the counter initially contains a count of two, so that the two consecutive cut marks may be missing without stopping the paper cutter, but the occurrence of more than two consecutive missing cut marks will cause the paper cutter to stop.

If two or less consecutive cut marks have been missing at the time the NOCTM routine is performed, the routine then subtracts the count contained in the step counter from the number of steps until ramp down and stores this result in the test counter. The number of steps until ramp down represents the total feed length of the last previous paper feed-and-cut cycle in which cut marks were sensed at both ends of the cycle less the number of steps in the ramp down.

The third number which is supplied to the test counter in missing cut mark operation is different than the third number which would be supplied to the test counter during normal automatic operation. The third number supplied during missing cut mark operation assures that the paper strip 18 will be fed by the same total feed length as the last print which had cut marks at both ends of the paper feed-and-cut cycle.

When the third number has been loaded into the test counter, the CTCHK subroutine shown in FIG. 20D is again performed and the MOVE routine again permits the stepper motor to take another step. The test counter is decremented with each step of the stepper motor until it again reaches zero. At that time, the RAMPD subroutine is performed and a fourth number (i.e. the number of steps of the down ramp until the end of the print) is retrieved. If this number is zero, the ENDPR routine is commenced. If, on the other hand, the number of steps is greater than zero so that a down ramp in stepper motor frequency is to occur, the fourth number is loaded into the test counter and the CTCHK subroutine is again performed. The CTCHK subroutine causes the MOVE routine to permit additional steps until the test counter again reaches zero. At this time, the ENDPR routine shown in FIGS. 22A-22F is commenced.

Figure 22A:
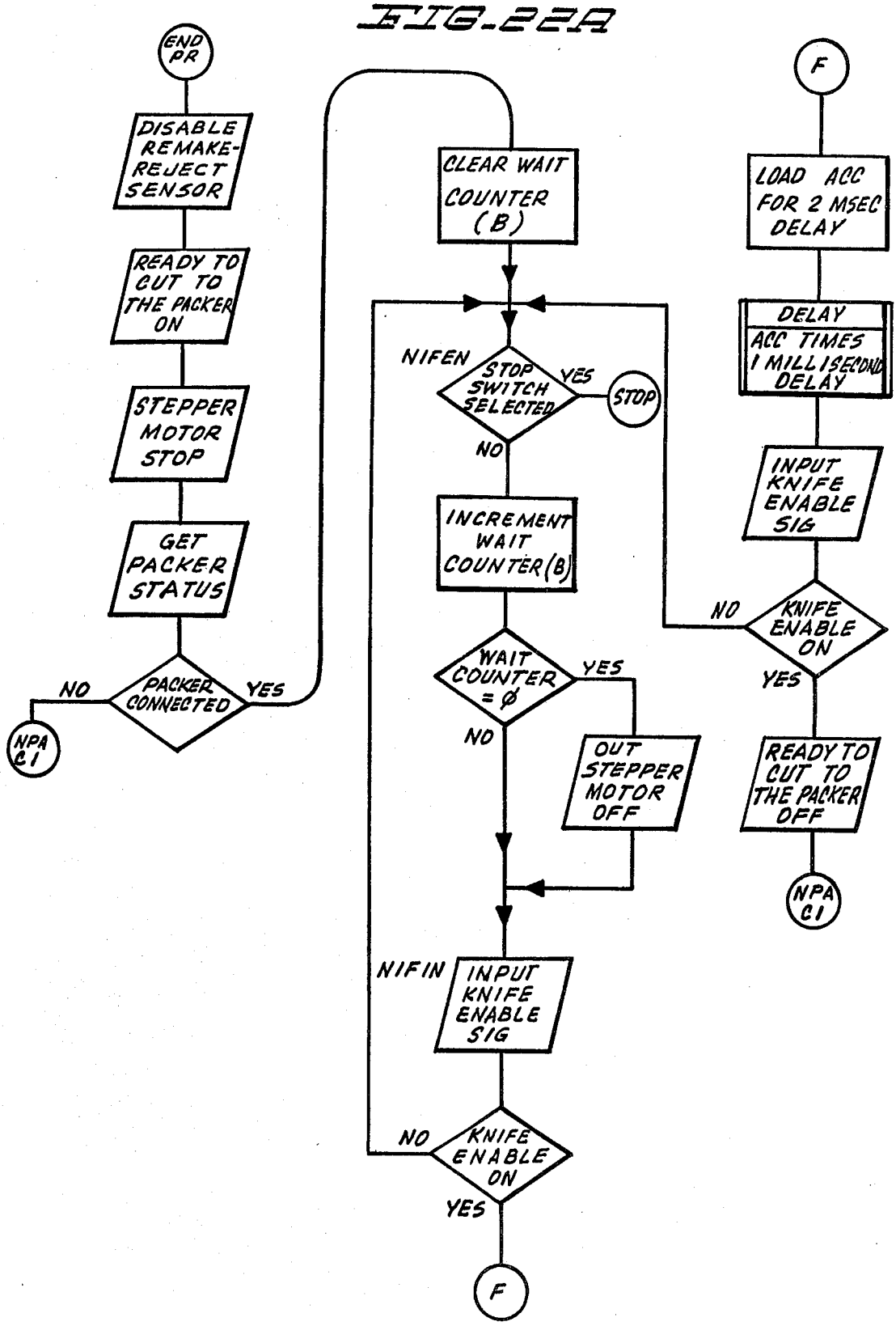
Figure 22B:
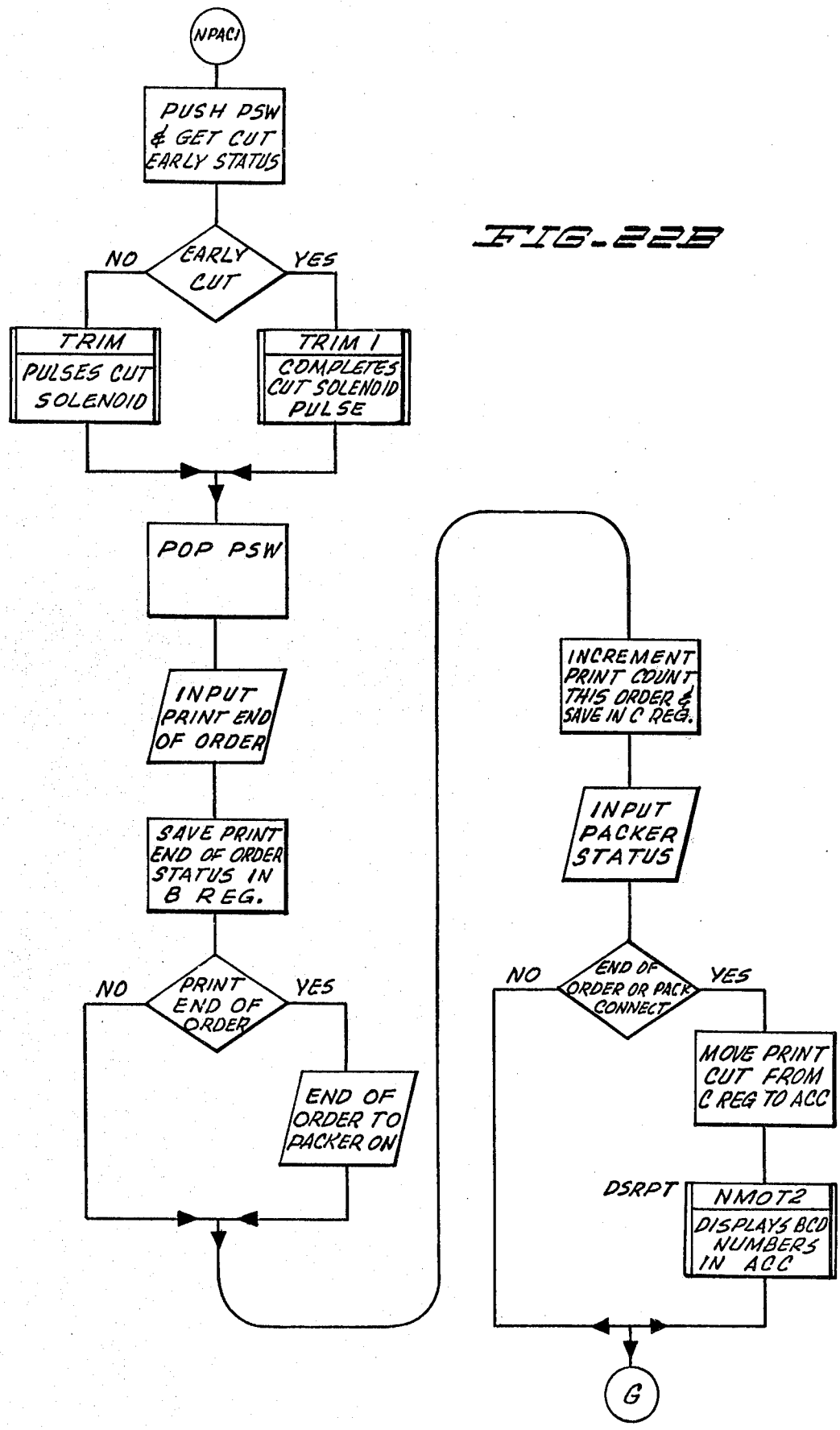

The ENDPR routine performs a variety of functions which are necessary to complete a paper feed-and-cut cycle. For example, the portion of the ENDPR routine shown in FIGS. 22A is concerned primarily with the enabling of the paper cutter knife assembly. The portion of the ENDPR routine shown in FIG. 22B is concerned primarily with displaying the number of prints cut in a particular order. This portion of the ENDPR routine is described in greater detail in the co-pending application entitled "Print and Order Totalizer for Automatic Paper Cutter". FIGS. 22D and 22E are concerned with the operation of the paper cutter if a slug must be cut out of the paper in between prints. In addition, these Figures describe the portion of the ENDPR routine which determines whether an end-of-order has occurred or whether the maximum number of prints have been cut, or whether another paper feed-and-cut cycle may be commenced starting with the PSTAR routine.

Figure 22C:
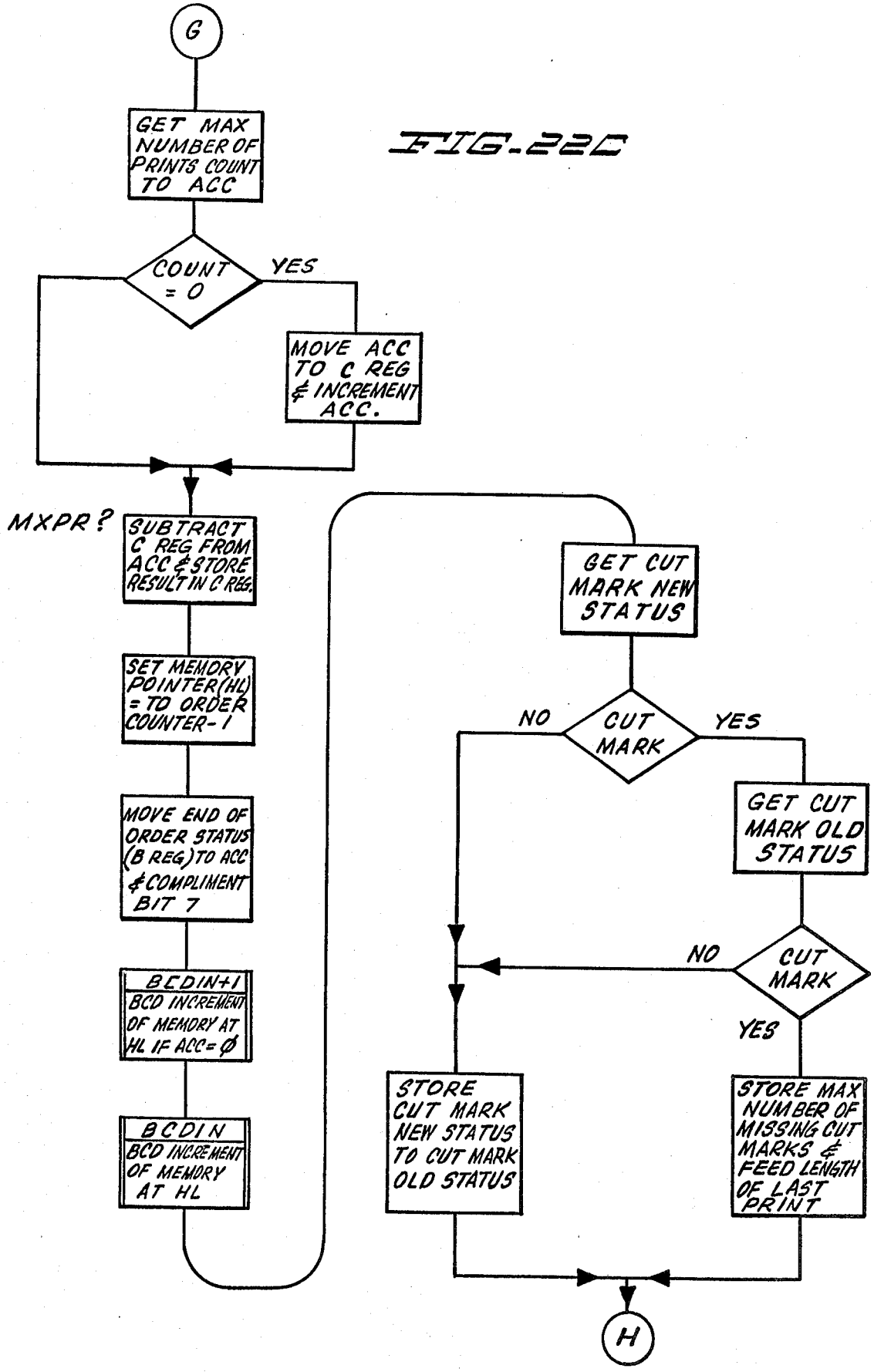
Figure 22D:
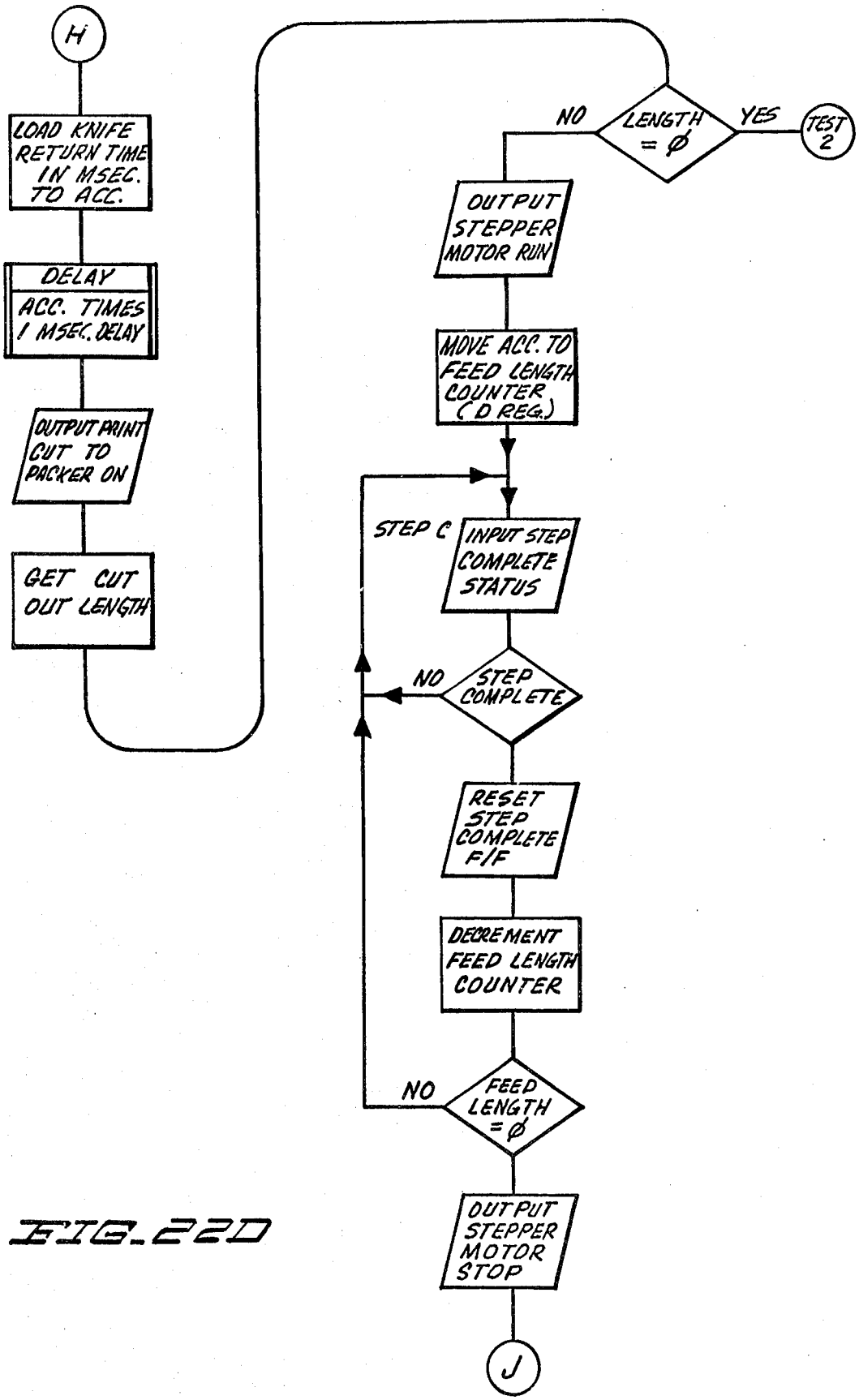
Figure 22E:
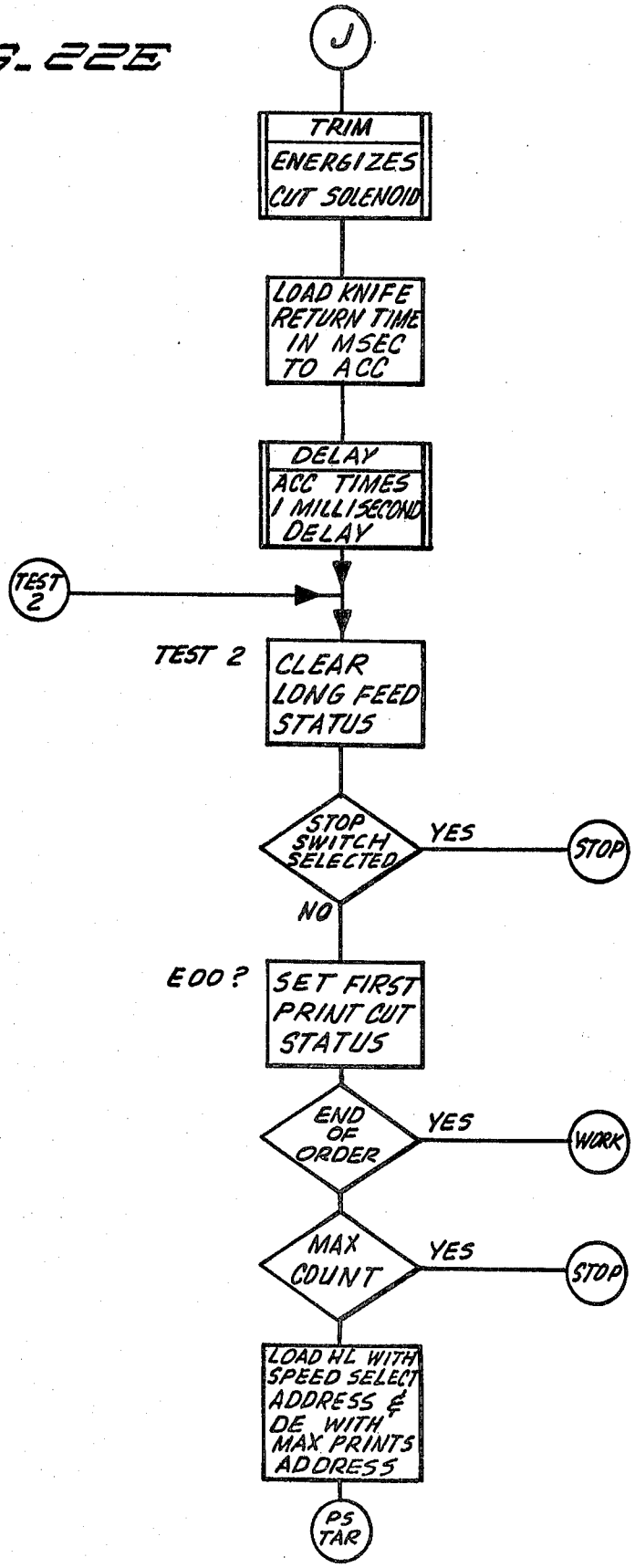

The portion of the ENDPR routine which is of primary interest to the present invention is shown in FIG. 22C. As shown in FIG. 22C, microprocessor 170 checks the "cut-mark-new" and "cut-mark-old" status. The "cut-mark-new" status indicates whether a cut mark was sensed during the paper feed-and-cut cycle which is now being completed, while the "cut-mark-old" status indicates whether a cut mark was sensed during the immediately preceding paper feed-and-cut cycle. If cut marks were sensed during both cycles, microprocessor 170 causes the maximum number of permissible missing cut marks to again be stored in the cut-mark-yet-to-miss counter which is decremented by the NOCTM routine. In addition, the total feed length of the paper feed-and-cut cycle just being completed is stored. In this way, microprocessor 170 continually updates the total feed length and the number of missing cut marks after each paper feed-and-cut cycle.

If a cut mark was missing in either the just completed paper feed-and-cut cycle or the immediately preceding cycle, the cut-mark-new status is transferred to the cut-mark-old status and stored. The count in the cut-mark-yet-to-miss counter and the stored total feed length are not changed if either cut mark status indicates a missing cut mark.

Conclusion

The present invention permits uninterrupted operation of an automatic paper cutter even though an occasional cut mark may be missing. In the event of an occasional missing cut mark, the paper is advanced by the total feed length of the last paper feed-and-cut cycle in which cut marks were sensed at both ends. This total feed length is continually updated with the completion of each paper feed-and-cut cycle. In the event that a predetermined number of consecutive paper feed-and-cut cycles occur without a cut mark being sensed, the operation of the automatic paper cutter is then stopped to permit the operator to determine the cause of the missing cut marks.

The present invention, therefore, overcomes the problem of occasional missing cut marks which result in inaccurate paper feeds or stopping of operation of the prior art automatic paper cutters. Interruption of operation of an automatic paper cutter or inaccurate feed of paper caused by a single missing cut mark can result in a significant loss in productivity, and, therefore, reduce profits for the photographic processing operation.

Although the present invention has been described with reference to preferred embodiments, workers skilled in the art will recognize that changes may be made in form and detail without departing from the spirit and scope of the invention. For example, although the present invention has been described in the context of a specific automatic photographic paper cutter, it will be recognized that the present invention may be applied to other automatic paper cutter systems as well.

What is claimed is:

1. In a photographic paper cutter for cutting photographic prints from a strip of photographic paper bearing cut indicia, the photographic paper cutter including paper feed drive means for driving the strip along a path, knife means for cutting the strip, and cut indicia sensing means for sensing the cut indicia, the improvement comprising:

storage means for storing a signal indicative of a total feed length for use if a cut indicium is not sensed within a predetermined portion of a paper feed-and-cut cycle, wherein the signal indicative of the total feed length is a function of the feed length of a previous cycle in which a cut indicium was sensed; and control means for controlling the paper feed drive means during a paper feed-and-cut cycle, the control means causing the paper feed drive means to drive the strip the total feed length if a cut indicium has not been sensed within a predetermined portion of the paper feed-and-cut cycle.

2. The invention of claim 1 further comprising:

termination means for terminating the paper feed-and-cut cycles after a predetermined number of cycles without a cut indicium sensed within the predetermined portion of a cycle.

3. The invention of claim 1 wherein the paper feed drive means drives the strip along a path in steps.

4. The invention of claim 3 wherein the control means comprises:

means for counting steps which the strip is driven by the paper feed drive means;

means for causing the paper feed drive means to drive the strip a first number of steps representing a minimum feed length before a valid cut indicium may be sensed;

means for causing the paper feed drive means to drive the strip a second number of steps representing the predetermined portion of the paper feed-and-cut cycle after the minimum feed length during which a valid cut indicium may be sensed; and means for causing the paper feed drive means to drive the strip an additional number of steps equal to the total number of steps in the total feed length for the last previous feed-and-cut cycle in which cut indicia were sensed minus the counted number of steps the strip has already been driven if a cut indicium has not been sensed during the predetermined portion.

5. The invention of claim 4 wherein the means for counting steps comprises:

step counter means for containing a step count which is incremented with each step driven; and test counter means for containing the test count which is decremented with each step.

6. The invention of claim 5 wherein the test counter is loaded with the first number of steps at the beginning of a cycle and is loaded with the second number of steps when the test count has been decremented from the first number to zero.

7. The invention of claim 6 wherein the test counter is loaded with a third number of steps when the test count has been decremented from the second number to zero and no cut indicium has been sensed.

8. The invention of claim 7 wherein the third number is equal to the total number of steps of the total feed length minus a number of steps of a desired down ramp in paper drive speed and minus the step count of the step counter means, and wherein the test counter means is loaded with a fourth number equal to the number of steps of the desired down ramp when the test count has been decremented from the third number to zero.

9. The invention of claim 8 wherein the paper feed drive means is stopped and the knife means cuts the strip when the test count has been decremented from the fourth number to zero.

10. The invention of claim 1 wherein the control means causes the paper drive means to drive the strip by a length determined by the cut indicium if a cut indicium is sensed within the predetermined portion.

11. The invention of claim 1 wherein the storage means comprises:

means for indicating at the end of each paper feed-and-cut cycle whether a cut indicium was sensed during the cycle just being completed;

means for indicating at the end of each cycle whether a cut indicium was sensed in the cycle immediately preceding the cycle just being completed;

means for sensing the total feed length of the cycle just being completed;

means for storing a signal indicative of a total feed length at the end of each cycle; and means for replacing the stored signal indicative of the total feed length of a preceding cycle with a signal indicative of the total feed length of the cycle just being completed if cut indicia were sensed during both the cycle just being completed and the cycle immediately preceding the cycle just being completed, and not replacing the stored signal indicative of the total feed length of a preceding cycle if a cut indicium was not sensed in either cycle.

12. The invention of claim 1 and further comprising:

cut-indicia-missing counter means for counting the number of consecutive cycles in which a cut indicium was not sensed;

means for resetting the cut-indicia-missing counter means to a predetermined first count if cut indicia were sensed in both the cycle just being completed and the immediately preceding cycle and not resetting the cut-indicia-missing counter if a cut indicium was not sensed in either cycle;

means for changing the count in the cut indicia counter with each cycle in which a cut indicium is not sensed; and menas for stopping the paper cutter when the cut-indicia-missing counter reaches a second predetermined count.

13. The invention of claim 12 wherein the first predetermined count is two and wherein the second predetermined count is minus 1.

14. A photographic paper cutter comprising:

knife means for cutting photographic paper;

paper feed drive means for driving the photographic paper during a plurality of paper feed-and-cut cycles;

cut indicia sensing means for sensing cut indicia on the photographic paper;

first storage means for storing a signal indicative of a feed-after-sense length;

second storage means for storing a signal indicative of a total feed length for use if no cut indicium is sensed, wherein the signal indicative of the total feed length is a function of the feed length of a previous cycle in which a cut indicium was sensed; and control means for controlling the paper feed means during a paper feed-and-cut cycle, the control means causing the paper feed drive means to advance the paper by a length determined by the signal indicative of a feed-after-sense length if a cut indicium is sensed within a predetermined feed length and causing the paper feed drive means to advance the paper by an additional length determined by the signal indicative of the total feed length if a cut indicium is not sensed within the predetermined feed length.

15. The photographic paper cutter of claim 14 and further comprising:

termination means for terminating the paper feed-and-cut cycles after a predetermined number of cycles without a cut indicium sensed within the predetermined feed length.

16. The photographic paper cutter of claim 14 wherein the control means comprises a microprocessor.

17. The photographic paper cutter of claim 16 wherein the first storage means comprises a digital feed-after-sense switch, the second storage means comprises a random access memory.

18. The photographic paper cutter of claim 17 wherein the paper feed drive means comprises stepper motor means.

19. The photographic paper cutter of claim 14 wherein the predetermined feed length equals a minimum feed length before which a valid cut indicium may be sensed plus a window length after the minimum feed length during which a valid cut indicium may be sensed.

20. The photographic paper cutter of claim 19 wherein the additional length equals the total feed length minus the length which the photographic paper has already been driven.

21. The photographic paper cutter of claim 14 wherein the previous cycle is the last previous feed-and-cut cycle in which both a beginning and an end cut location of the photographic print cut during the cycle were determined by sensed cut indicia.

22. In a photographic paper cutter for cutting photographic prints from a strip of photographic paper bearing a cut indicia, the photographic paper cutter including paper feed drive means for driving the strip along a path, knife means for cutting the strip, and cut indicia sensing means for sensing the cut indicia, the improvement comprising:

storage means for storing a signal indicative of a total feed length for use if a cut indicium is not sensed within a predetermined portion of a paper feed-and-cut cycle;

control means for controlling the paper feed drive means during a paper feed-and-cut cycle, the control means causing the paper feed drive means to drive the strip the total feed length if a cut indicium has not been sensed within a predetermined portion of the paper feed-and-cut cycle;

counter means for counting consecutive cycles in which no cut indicium has been sensed within the predetermined portion of a cycle; and termination means for terminating the paper feed-and-cut cycles when the count of the counter means indicates that a predetermined plurality of consecutive cycles have occurred without a cut indicium being sensed within the predetermined portion of the cycle.

23. In a photographic paper cutter for cutting photographic prints from a strip of photographic paper bearing cut indicia, the photographic paper cutter including paper feed drive means for driving the strip along the path, knife means for cutting the strip, and cut indicia sensing means for sensing the cut indicia, the improvement comprising:

storage means for storing a signal indicative of a total feed length for use if a cut indicium is not sensed within a predetermined portion of a paper feed-and-cut cycle;

control means for controlling the paper feed drive means during a paper feed-and-cut cycle, the control means causing the paper feed drive means to drive the strip the total feed length if a cut indicium has not been sensed within a predetermined portion of the paper feed-and-cut cycle;

counter means for counting towards a predetermined number in response to each cycle in which a cut indicium has not been sensed within a predetermined portion of the cycle;

reset means for resetting the counter means in response to each cycle in which the cut indicium is sensed within the predetermined portion of the cycle; and termination means for terminating the paper feed-and-cut cycles if the count in the counter means is the predetermined number.

24. The invention of claim 23 wherein the counter means counts down in response to each cycle in which a cut indicium has not been sensed, and wherein the reset means resets the counter means to a predetermined positive integer in response to each cycle in which a cut indicium is sensed.

25. The invention of claim 24 wherein the predetermined number is a negative integer.

* * * * *